US006789968B2

(12) United States Patent
Maruyama et al.

(10) Patent No.: US 6,789,968 B2
(45) Date of Patent: Sep. 14, 2004

(54) PRINTER HAVING A SELECTOR ASSOCIATED WITH A CARRIAGE FOR ACTUATING A PLURALITY OF SWITCHING MECHANISMS

(75) Inventors: Akihiko Maruyama, Nagano (JP); Toshiyuki Sasaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 43 days.

(21) Appl. No.: 10/178,785

(22) Filed: Jun. 25, 2002

(65) Prior Publication Data

US 2003/0012591 A1 Jan. 16, 2003

(30) Foreign Application Priority Data

Jun. 25, 2001 (JP) ..... 2001-191873
Oct. 1, 2001 (JP) ..... 2001-305803

(51) Int. Cl.[7] ..... B41J 13/02
(52) U.S. Cl. ..... 400/636.1; 400/320
(58) Field of Search ..... 400/76, 637, 636.2, 400/636.1, 636, 642, 630, 342, 319, 320; 347/104, 16, 101; 235/440, 444

(56) References Cited

U.S. PATENT DOCUMENTS 4,613,246 A * 9/1986 Sugiura et al. ..... 400/320
5,360,279 A 11/1994 Asai et al. ..... 400/216.1
5,468,078 A * 11/1995 Asai et al. ..... 400/215
5,742,316 A 4/1998 Hirano et al. ..... 347/104
5,965,862 A * 10/1999 Momose ..... 235/449
6,068,187 A 5/2000 Momose ..... 235/449
6,431,774 B1 * 8/2002 Matsumoto ..... 400/225
6,447,183 B2 * 9/2002 Ford ..... 400/320

FOREIGN PATENT DOCUMENTS

| | | |
|---|---|---|
| EP | 0 422 794 | 4/1991 |
| EP | 0 482 356 | 4/1992 |
| EP | 0 650 845 | 5/1995 |
| EP | 1 029 699 | 8/2000 |
| JP | 59-52680 | 3/1984 |
| JP | 04-148972 | 5/1992 |
| JP | 5-24281 | 2/1993 |
| JP | 5-31914 | 2/1993 |
| JP | 5-318893 | 12/1993 |
| JP | 8-267871 | 10/1996 |
| JP | 09-109383 | 4/1997 |
| JP | 10-044450 | 2/1998 |
| JP | 09-095022 | 4/1999 |
| JP | 11-138783 | 5/1999 |
| JP | 2001-268315 | 9/2001 |

* cited by examiner

*Primary Examiner*—Anthomy H. Nguyen
(74) *Attorney, Agent, or Firm*—Nixon & Vanderhye P.C.

(57) ABSTRACT

A printer having a plurality of switching mechanisms movable between a first position and a second position. A selector is associated with a carriage of the printer such that the carriage moves the selector so as to actuate at least one of the switching mechanisms to the second position when the carriage moves to the first non-printing region, and so as to actuate the at least one of the switching mechanisms to the first position when the carriage moves to the second non-printing region.

13 Claims, 28 Drawing Sheets

FIG. 22

| SWITCHING MECHANISM | CAM POSITION | | |
|---|---|---|---|
| | LEFT | INTERMEDIATE | RIGHT |
| PUMP/ROLLER SWITCHING | ROLLER | ROLLER | PUMP |
| PAPER FEED ROLLER ACTUATING | CLOSED | CLOSED | OPEN |
| POSITIONING STOPPER ACTUATING | RETRACTABLE | RETRACTABLE | PROJECTED |
| MICR ACTUATING | CLOSED | OPEN | OPEN |

PRINTER HAVING A SELECTOR ASSOCIATED WITH A CARRIAGE FOR ACTUATING A PLURALITY OF SWITCHING MECHANISMS

BACKGROUND OF THE INVENTION

1. Field of the Invention

The present invention relates to a printer which has a carriage for actuating a print head back and forth across a paper transporting path and causes a plurality of switching mechanisms to perform switching actions by utilization of operating power of the carriage.

2. Description of the Related Art

A multifunctional printer has recently been pursued. For example, a known business printer used in a store or the like subjects a plurality of types of paper, such as bills, vouchers, or coupons, to printing or performs magnetic-ink character recognition (MICR) of a check or front/reverse printing operations in a composite manner. This type of printer has a plurality of switching mechanisms for switching the status of the printer and causes the plurality of switching mechanisms to perform switching operations in accordance with the type of paper or a step of processing paper.

In a related-art printer, a solenoid is used to supply power to the switching mechanisms. However, restrictions are imposed on the solenoid in terms of operating load or operating strokes, and hence, difficulty is encountered in actuating a plurality of switching mechanisms through use of one solenoid. Furthermore, in order to retain the statuses of the switching mechanisms using a solenoid, a current must be continuously applied to the solenoid, thereby resulting in an increase in power consumption.

There is another related-art technique described in Japanese Patent Publication No. 5-318893A. In this technique, a rotatable print track setting member is provided in one non-printing region, while a setting release member is provided in the other non-printing region. The height of a pivotable ribbon frame relative to a print head is adjusted by changing the position of a carriage so as to change the rotation amount of the print track setting member. Moreover, the ribbon frame is released from the setting by pivotally actuating the setting release member. However, as mentioned above, the ribbon frame, the print track setting member, and the setting release member are required. Although a large number of parts are employed, the only available function is that of switching colors of ink ribbons.

SUMMARY OF THE INVENTION

An object of the invention is to provide a printer in which a plurality of switching mechanisms are actuated by utilizing an operation force of a carriage, to obviate a solenoid to be used for actuating the respective switching mechanisms, and to achieve simplification and power conservation of an electric circuit and a reduction in the number of parts of the printer.

In order to achieve the object, according to the present invention, there is provided a printer, comprising:

- a paper transporting path, which guides paper;
- a print head, which performs printing on the paper placed in the paper transporting path;
- a carriage, which mounts the print head and reciprocates in a direction orthogonal to the paper transporting path;
- a printing region provided within a reciprocating range of the carriage, in which the print head is allowed to perform printing;

- a first non-printing region provided within the reciprocating range of the carriage, in which the print head is not allowed to perform printing, the first non-printing region provided adjacent to one side of the printing region;
- a second non-printing region provided within the reciprocating range of the carriage, in which the print head is not allowed to perform printing, the second non-printing region provided adjacent to the other side of the printing region;
- a plurality of switching mechanisms, each switching mechanism being movable between a first position and a second position; and
- a selector associated with the carriage such that the carriage moves the selector so as to actuate at least one of the switching mechanisms to the second position when the carriage moves to the first non-printing region, and actuate the at least one of the switching mechanisms to the first position when the carriage moves to the second non-printing region.

In the configuration, there is provided a selector for actuating the plurality of switching mechanisms only when the carriage is situated in the non-print areas. The plurality of switching mechanisms can be actuated by changing the position of selector. Hence, use of solenoids for activating the respective switching mechanisms is obviated, thereby enabling simplification of an electric circuit and curtailing of the number of parts of the printer.

Preferably, the selector is movable at least among a first selector position, a second selector position and a third selector position. The first non-printing region includes at least a first switching position and a second switching position, and the second non-printing region includes at least a first restoration position and a second restoration position. The selector is placed at either one of the first, the second or the third selector positions to actuate the at least one switching mechanism to the second position, when the carriage is placed at either one of the first switching position or the second switching position. The selector is placed at either one of the first, the second or the third selector positions to actuate the at least one switching mechanism to the first position, when the carriage is placed at either one of the first restoration position or the second restoration position.

In this case, a combination of switched statuses of the respective switching mechanisms can be changed, and hence there can be effected switching control operation equal to that achieved when the respective switching mechanisms are provided with solenoids.

Here, it is preferable that the printer further comprises a pair of paper feed rollers, which transports the paper in the paper transporting path. The switching mechanisms include a paper feed roller actuating mechanism which opens or closes a space between the paper feed rollers.

In this case, a plurality of switching mechanisms, including the paper feed roller actuating mechanism, can be actuated by utilization of power supplied to the carriage.

Here, it is preferable that the paper feed roller includes a stationary feed roller and a movable feed roller which is retractably contacted with the stationary feed roller. The paper feed roller actuating mechanism includes a switcher which changes a position of the movable feed roller with respect to the stationary feed roller. The switcher is actuated when the switcher sits astride an operating section of the selector.

In this case, the selector and the switcher are arranged in an overlapping manner, thus improving a layout efficiency.

Moreover, a reaction force of the switcher is prevented from acting in the moving direction of the selector, in turn, preventing occurrence of deviation of the switcher.

Here, it is preferable that the printer further comprises a positioning stopper against which a leading end of the paper in the paper transporting path is abutted. The switching mechanisms include a positioning stopper actuating mechanism which actuates the positioning stopper so as to be projected into the paper transporting path or retracted therefrom.

In this case, a plurality of switching mechanisms, including the positioning stopper actuating mechanism, can be actuated by utilization of power supplied to the carriage.

Further, it is preferable that the printer further comprises an MICR head, which reads at least one magnetic character pre-printed on the paper; and a retainer, which retains the paper on the MICR head. The switching mechanisms include an MICR actuating mechanism which opens or closes a space between the MICR head and the retainer.

In this case, a plurality of switching mechanisms, including the MICR actuating mechanism, can be actuated by utilization of power to the carriage.

Here, it is preferable that the paper feed roller actuating mechanism is actuated at one of the first and the second switching positions, and at one of the first and the second restoration positions. The MICR actuating mechanism is actuated at the other one of the first and the second switching positions, and at the other one of the first and the second restoration position.

In this case, the paper feed roller actuating mechanism and the MICR actuating mechanism can be selectively switched according to the kind of paper or processing status, and their switched statuses can be selectively restored.

Here, it is preferable that the paper feed roller actuating mechanism is actuated so as to close the space between the paper feed rollers at the first switching position, and so as to open the space at the second restoration position. The MICR actuating mechanism is actuated so as to close the space between the MICR head and the retainer at the second switching position, and so as to open the space at the first restoration position. The second switching position is placed outwardly from the first switching position in the first non-printing region. The second restoration position is placed outwardly from the first retraction position in the second non-printing region.

In this case, the paper feed roller actuating mechanism and the MICR actuating mechanism can be actuated accompanyingly or independently. Consequently, switching control can be effected according to the type of paper and a processing status.

There is also provided a method of controlling the above printer, comprising the steps of:

- detecting an insertion of the paper into the paper transporting path;
- moving the carriage to the second switching position via the first switching position;
- reading the magnetic character on the paper by the MICR head while transporting the paper by the paper feed rollers;
- moving the carriage to the first restoration position; and
- performing printing on the paper by the print head while transporting the paper by the paper feed roller.

Preferably, the printer further comprises: a pump, which supplies ink to the print head; and a paper feed roller, which transports the paper in the paper transporting path. The switching mechanisms include a pump/roller switching mechanism which selectably transmits a driving force to either one of the pump and the paper feed roller.

In this case, a plurality of switching mechanisms, including the pump/roller switching mechanism, can be actuated by utilization of power supplied to the carriage.

Preferably, the second non-printing region is provided as a home position of the carriage. In this case, all switching mechanisms can be initialized through an initializing operation for restoring the switched statuses of the respective switching mechanisms, by only returning the carriage to its home position. Hence, the time required for the initializing operation can be shortened.

Preferably, the switching mechanisms include: at least one pair of stationary gears; a switcher, moved by the selector; a movable gear, moved by the switcher to mesh with one of the stationary gears while being rotated.

In this case, meshing of the movable gear with the stationary gears is switched smoothly, thereby preventing occurrence of trouble, which would otherwise be caused by meshing failures.

BRIEF DESCRIPTION OF THE DRAWINGS

The above objects and advantages of the present invention will become more apparent by describing in detail preferred exemplary embodiments thereof with reference to the accompanying drawings, wherein:

FIG. 22 is a table showing states of switching mechanisms at respective cam positions;

DETAILED DESCRIPTION OF THE PREFERRED EMBODIMENTS

Figure 1:
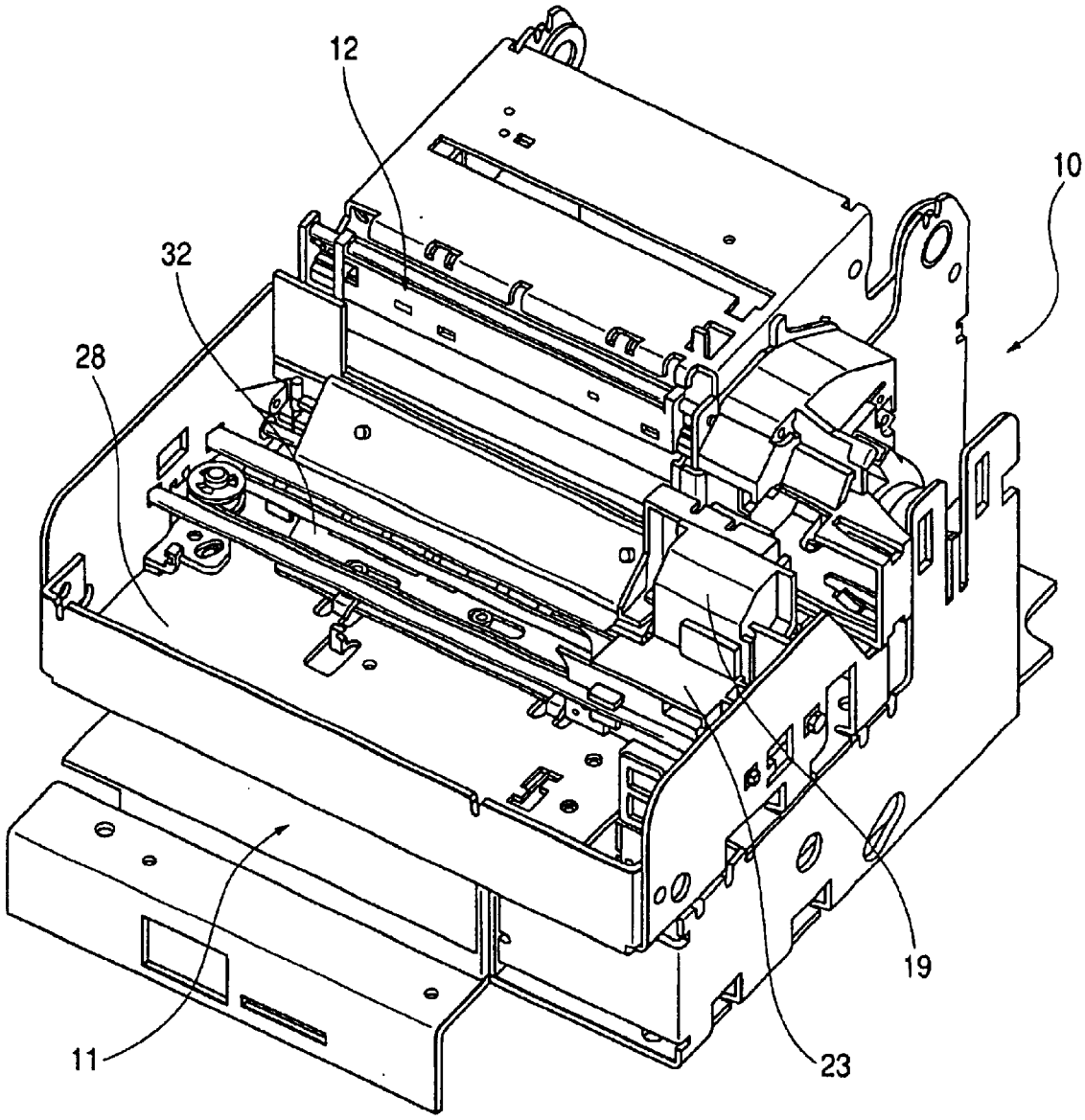
FIG. 1 is a perspective view of a printer according to a first embodiment of the invention.
Figure 2:
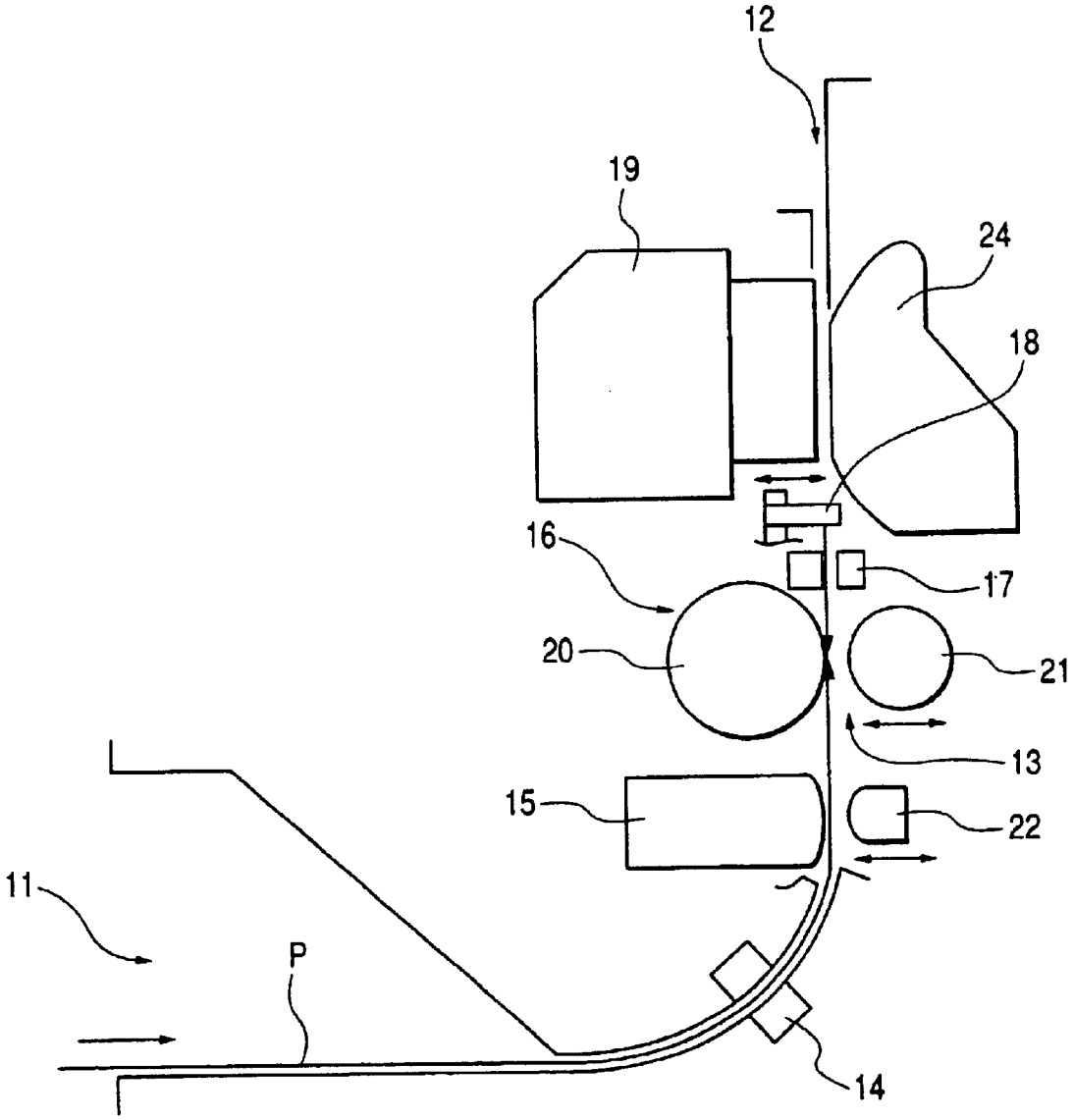
FIG. 2 is a schematic side view showing the inside of the printer.

An embodiment of the invention will be described hereinbelow with reference to the accompanying drawings. FIG. 1 is a perspective view of a printer according to an embodiment of the invention. FIG. 2 is a schematic side view showing the inside of the printer. As shown in the drawings, an inlet 11 is formed in a front face of a printer 10 for enabling manual insertion of paper P, such as checks or cut sheets. Of course, one of ordinary skill in the art will recognize that while the embodiments described herein describe printers using paper, any printable-medium will suffice. An outlet 12 is formed in an upper face of the printer 10 for enabling output of printed paper P. Formed in the printer 10 is a paper transporting path 13 which extends from the inlet 11 to the outlet 12 and has an L-shaped form when viewed in side cross section. Provided along the paper transporting path 13 are, in sequence from the inlet 11, a first paper sensor 14, an MICR head 15, a pair of paper feed rollers 16, a second paper sensor 17, a positioning stopper 18, and a print head 19.

The first and second paper sensors 14, 17 are each constituted of, for example, a transparent or reflection-type photo sensor and detect presence/absence of the paper P at respective positions on the paper transporting path 13. The positioning stopper 18 is for positioning the paper P inserted by way of the inlet 11. The positioning stopper 18 is switched between an attitude of projecting into the paper transporting path 13, to thereby catch the leading edge of the paper P, and an attitude of receding from the paper transporting path 13, to thereby permit passage of the paper P. The pair of paper feed rollers 16 include drive rollers 20 and retainer rollers 21, which oppose each other with the paper transporting path 13 interposed therebetween. The paper P is nipped and transported in accordance with actuation of the drive rollers 20. The retainer rollers 21 advance or recede with respect to the drive rollers 20. The retainer rollers 21 are switched between an attitude of pressing the drive rollers 20 against the paper P and an attitude of receding from the drive rollers 20, to thereby permit passage of the paper P.

In this embodiment, the MICR head 15 is for reading magnetic ink characters previously printed on a check. On the basis of the data read by the MICR head 15, a determination is made as to whether or not the check is valid. Provided in a position opposite the MICR head 15 is a retainer 22 for pressing the check against the MICR head 15. The retainer 22 is switched between an attitude of advancing or receding with respect to the MICR head 15 and an attitude of receding from the MICR head 15, to thereby permit passage of the paper P.

The print head 19 is provided on a carriage 23 which is actuated back and forth in a horizontal direction (i.e., across the paper transporting path 13). The print head 19 prints a row of characters or a plurality rows of characters on the front face of the paper P whose reverse face is pressed by a platen 24, through dot matrix printing.

The print head 19 performs ink jet printing, and ink is supplied to the print head 19 from an ink container (not shown) in accordance with actuation of an unillustrated ink supply pump.

Figure 3:
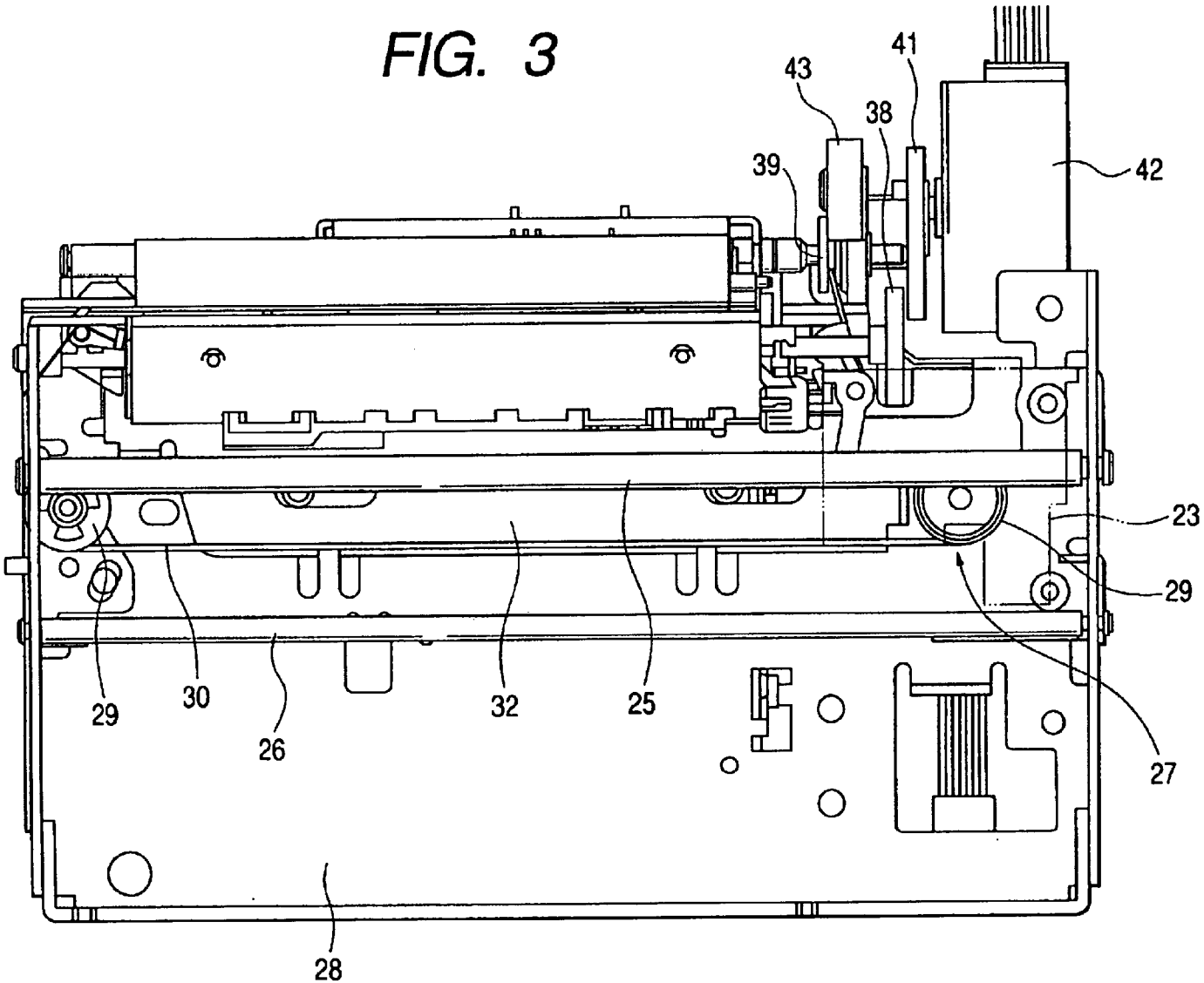
FIG. 3 is a plan view showing a carriage driving mechanism.
Figure 4:
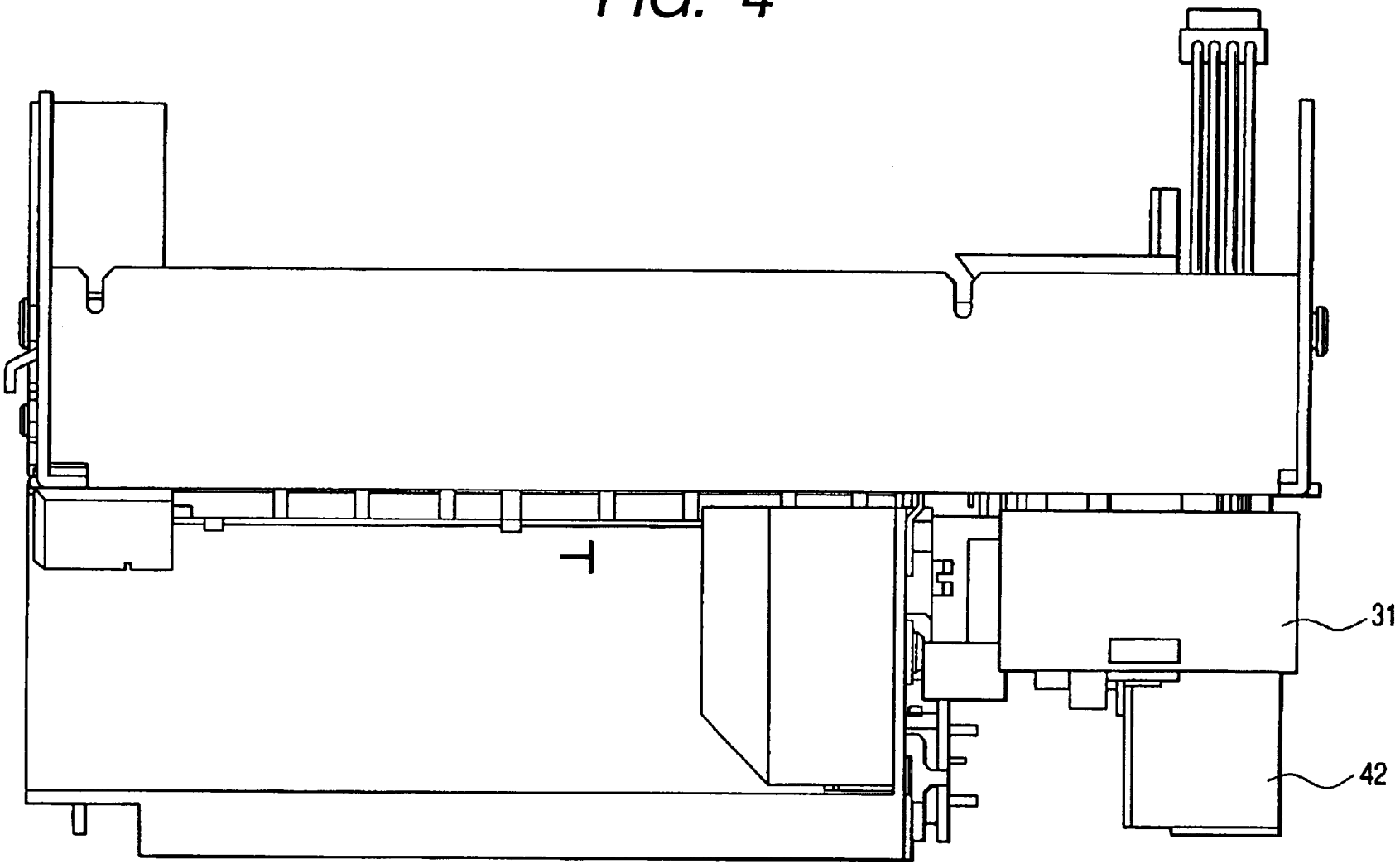
FIG. 4 is a front view showing the carriage driving mechanism.
Figure 5:
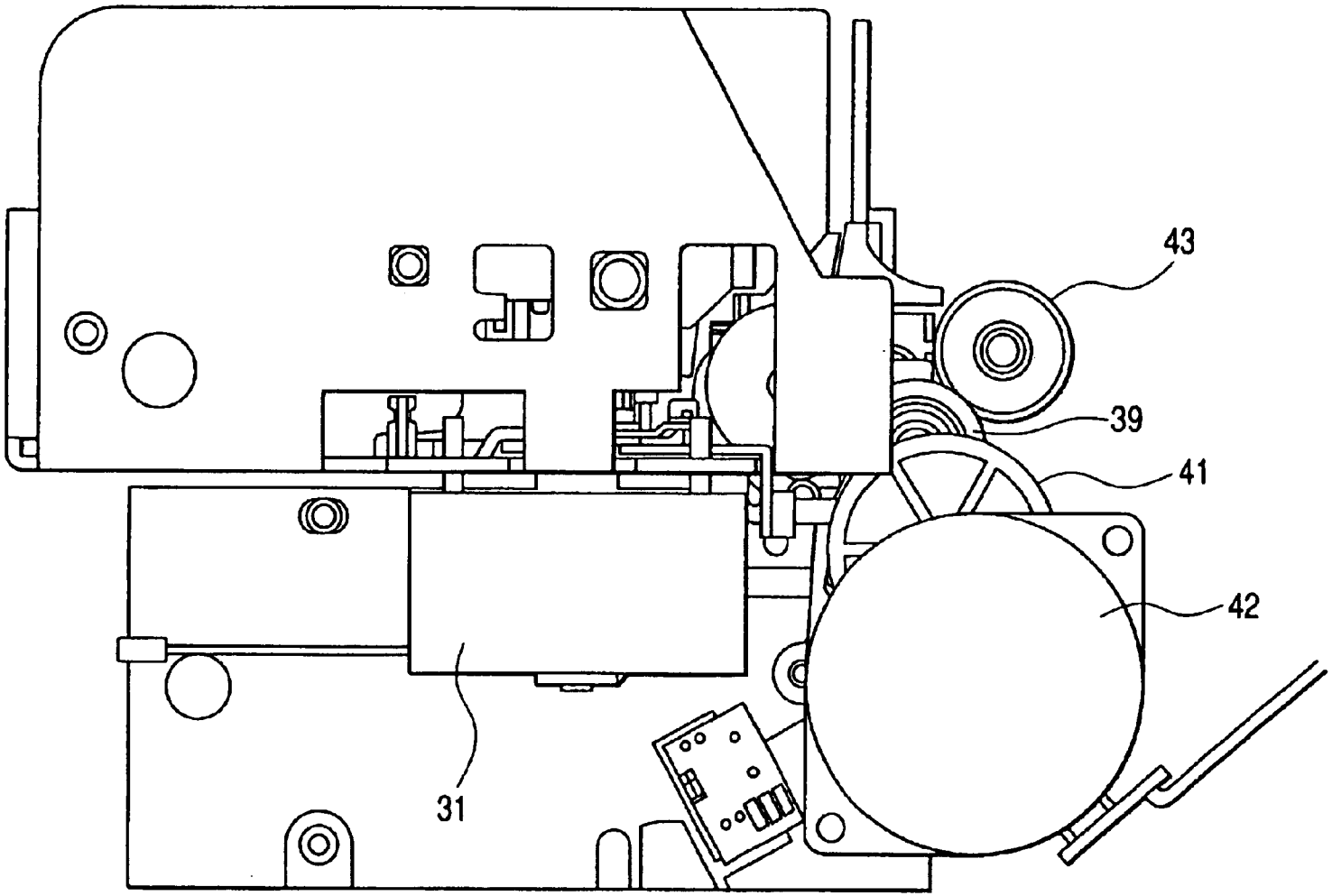
FIG. 5 is a right-side view showing the carriage driving mechanism.

FIG. 3 is a plan view showing a carriage driving mechanism; FIG. 4 is a front view showing the carriage driving mechanism; and FIG. 5 is a right-side view showing the carriage driving mechanism. As shown in the drawings, the carriage 23 is supported by a pair of guide shafts 25, 26 so as to be movable horizontally, wherein the guide shafts 25, 26 are arranged side by side with respect to the direction perpendicular to the horizontal direction. In accordance with actuation of the carriage driving mechanism 27, the carriage 23 is actuated. The carriage driving mechanism 27 comprises a pair of pulleys 29 provided on a carriage frame 28; a belt 30 routed around the pulleys 29 and linked to the carriage 23 at a predetermined position; and a carriage motor 31 for rotating one of the pulleys 29 forward or in reverse. In accordance with forward and reverse movement of the carriage motor 31, the carriage 23 is moved horizontally.

Figure 6:
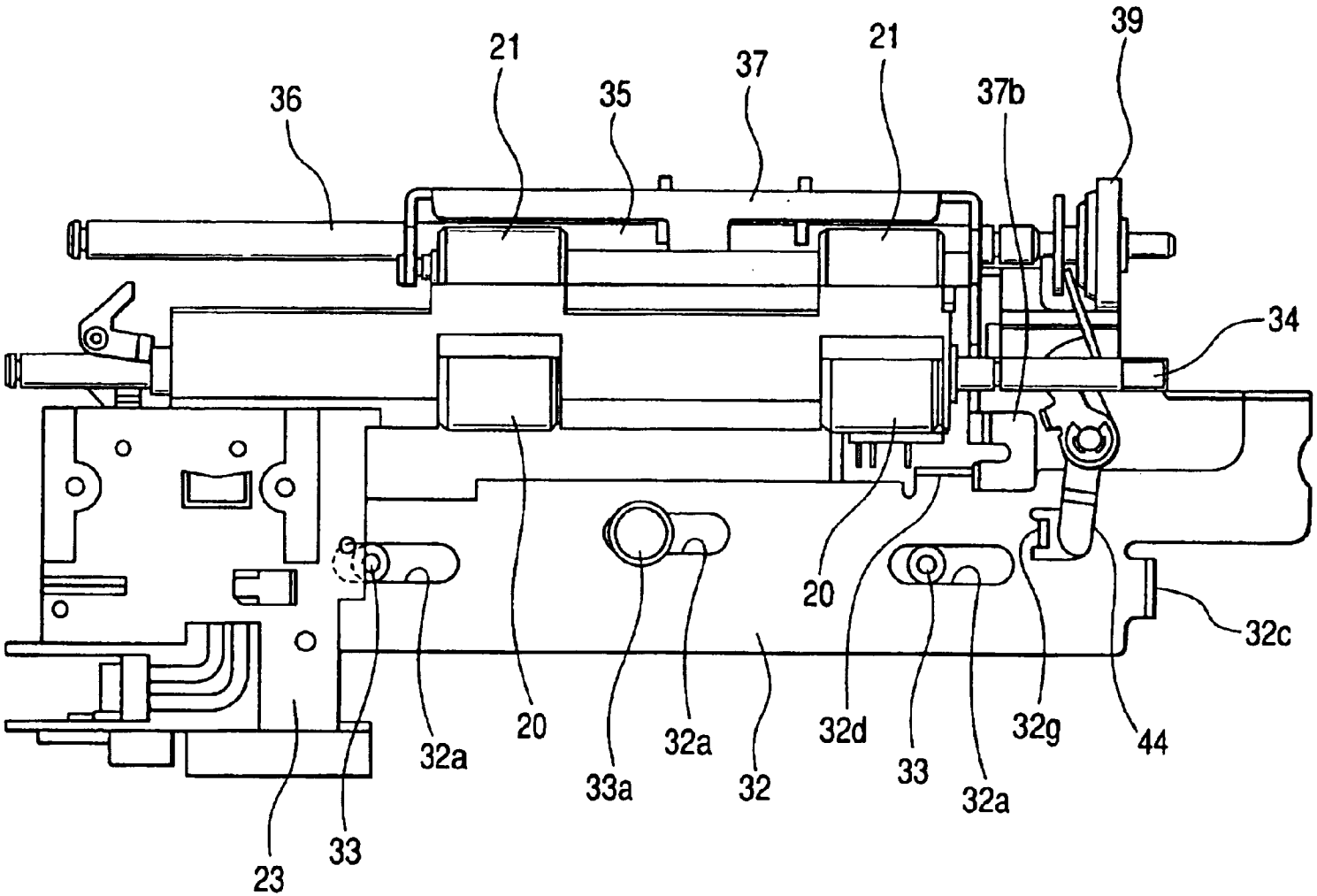
FIG. 6 is a plan view showing a selector plate and various types of switching mechanisms.
Figure 7:
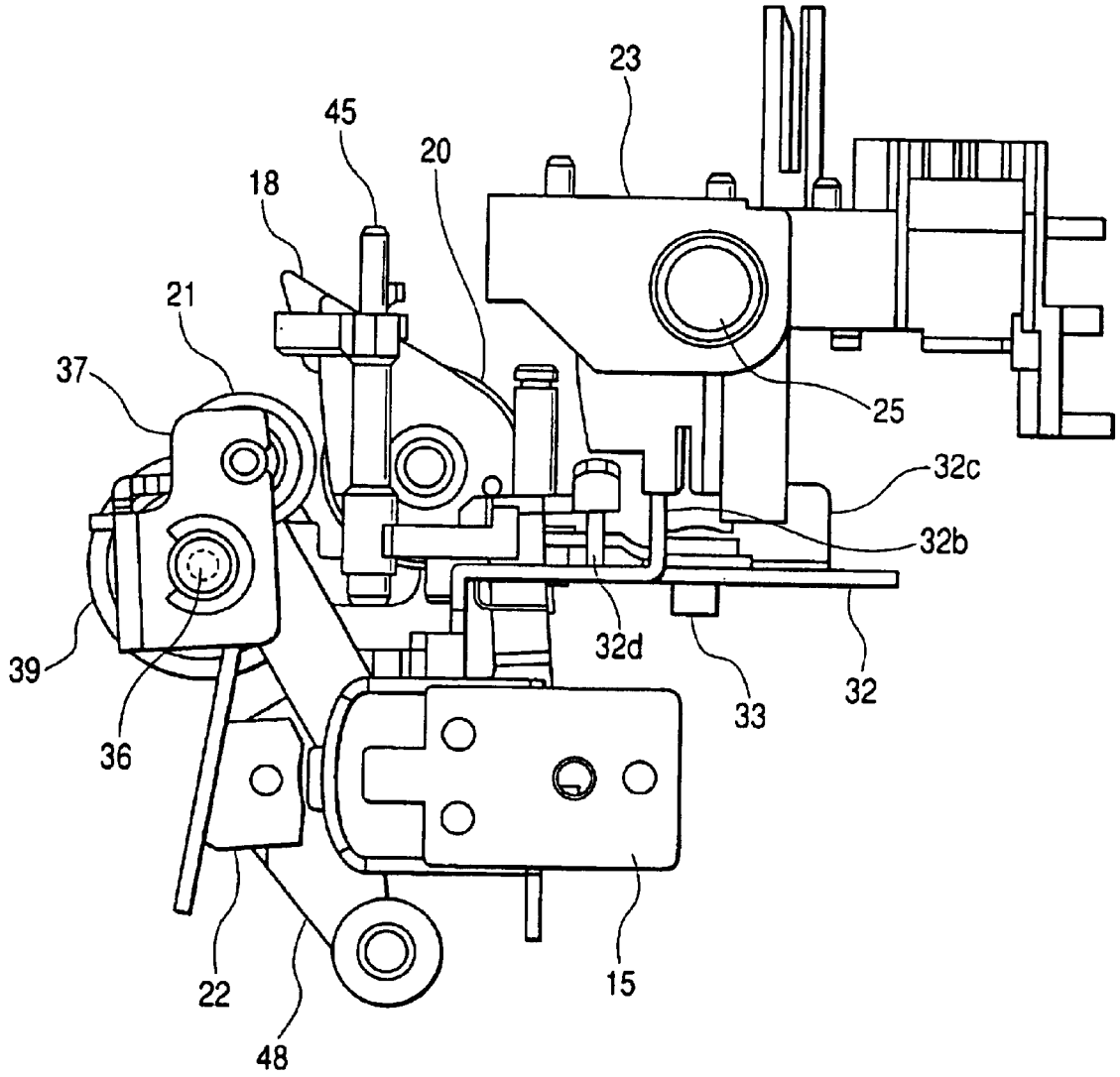
FIG. 7 is a left-side view showing the selector plate and the switching mechanisms.
Figure 8:
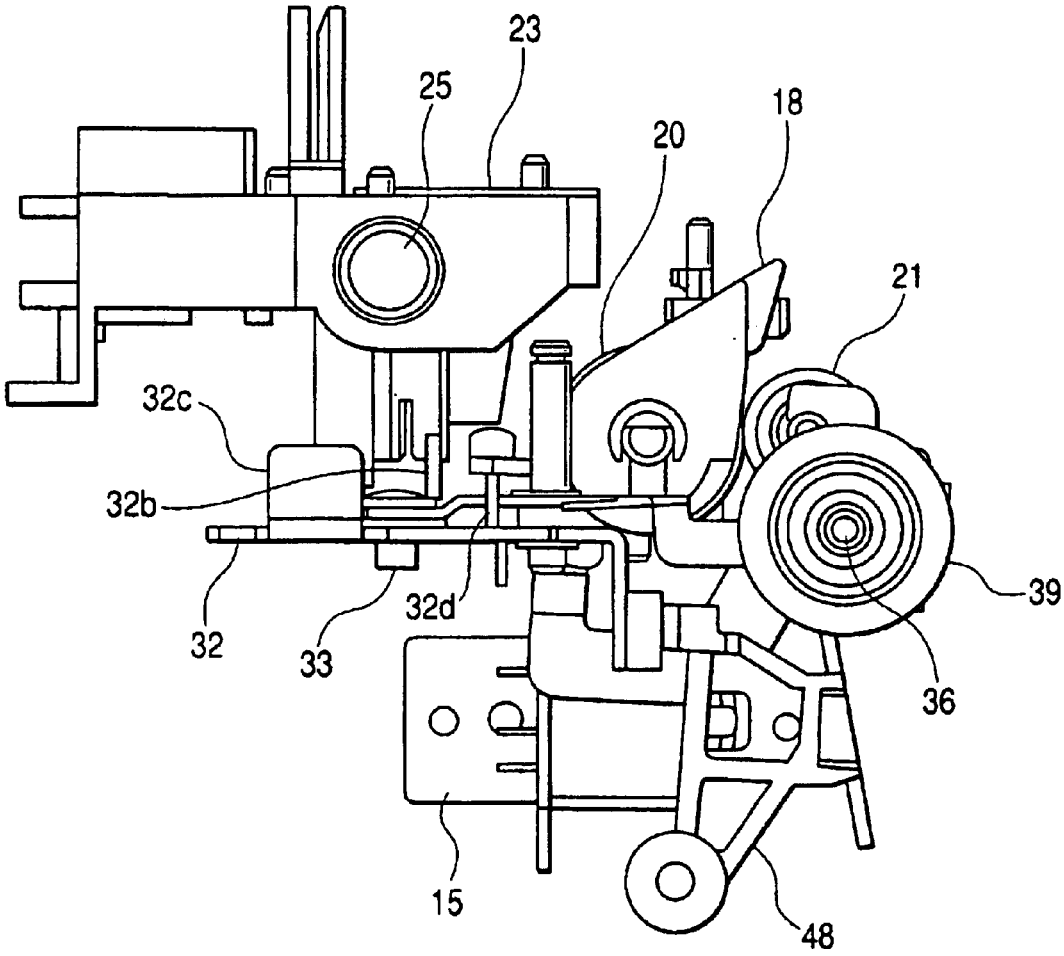
FIG. 8 is a right-side view showing the selector and the switching mechanisms.

FIG. 6 is a plan view showing a selector plate and various types of switching mechanisms; FIG. 7 is a left-side view showing the selector plate and the switching mechanisms; and FIG. 8 is a right-side view showing the selector plate and the switching mechanisms.

As shown in the drawings, a horizontally-movable selector plate 32 is provided on the carriage frame 28. The selector plate 32 is a plate whose longitudinal dimension is along a horizontal direction. A horizontally-elongated hole 32*a* is formed in each side of the selector plate 32 and at an intermediate position thereof.

The selector plate 32 is fastened to the carriage frame 28, by causing the elongated holes 32*a* provided in respective longitudinal ends to engage with guide pins 33 formed on the carriage frame 28. Further, a truss-head machine screw 33*a* is screwed into the center elongated hole 32*a* by way of an unillustrated disc spring. As a result, the selector plate 32 is supported so as to be horizontally slidable in the direction parallel to the traveling direction of the carriage 23. Further, frictional load caused by the disk spring is imparted to the selector plate 32, and hence, the selector plate 32 does not slide even when subjected to minute vibration. Accordingly, the selector plate 32 is supported on the carriage frame 28 so as to be held in respective cam positions.

Engagement lugs 32*b*, 32*c* which are to come into contact with the carriage 23 in a non-print region are formed on respective ends of the selector plate 32 so as to be folded and extend upward. The engagement lug 32*b* is an engagement section with which the carriage 23 comes into contact when having moved to a left non-print region. By this engagement section, the selector plate 32 is moved leftward in conjunction with the carriage 23. The engagement lug 32*c* is an engagement section with which the carriage 23 comes into contact when having moved to a right non-print region. As a result, the selector plate 32 is moved rightward in conjunction with the carriage 23.

Figure 23:
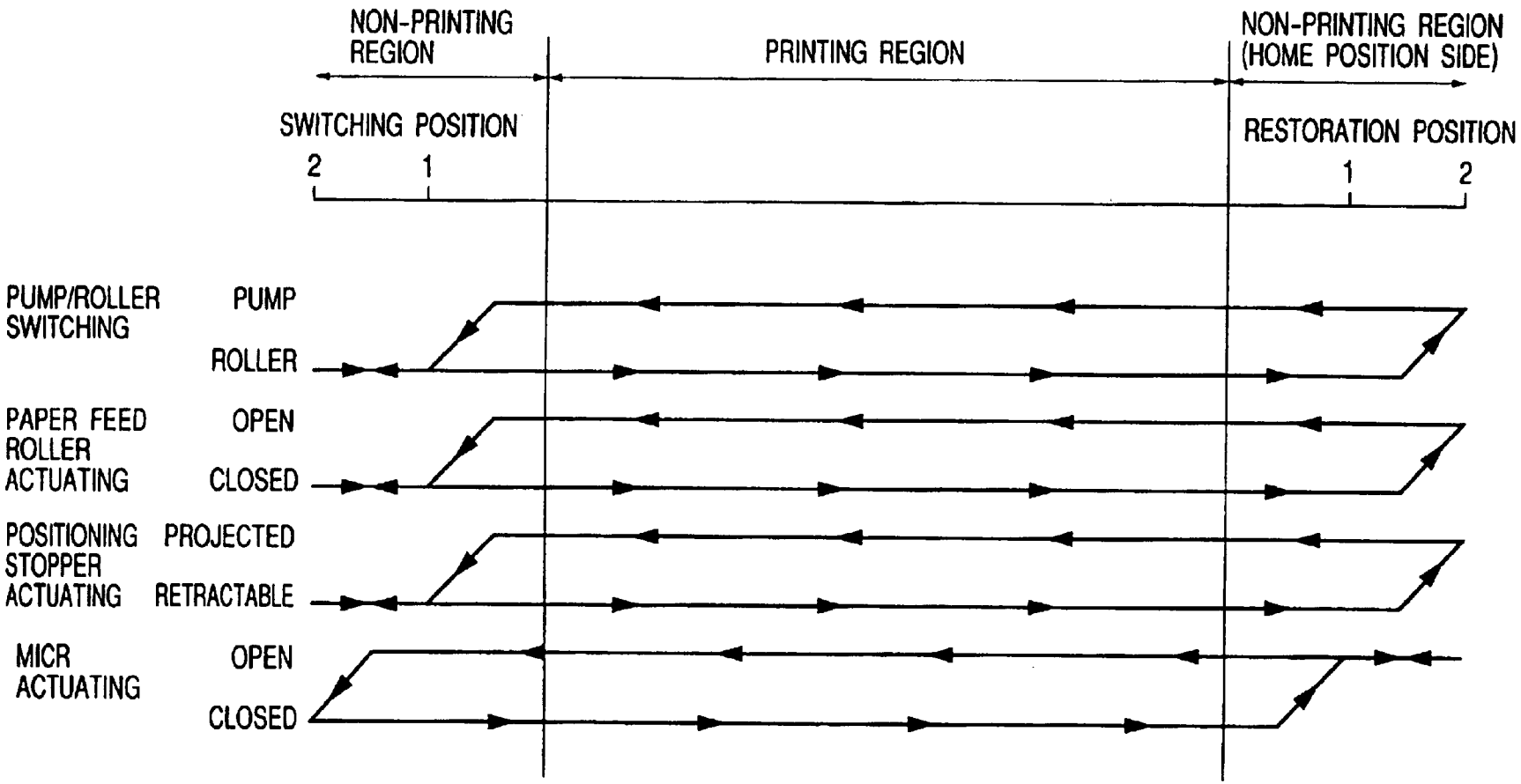
FIG. 23 is a chart showing operation timings of the switching mechanisms.

As shown in FIGS. 22 and 23, in the embodiment three cam positions are set for the selector plate 32. Explanation is now given by use of an example in which two switching positions are provided on either non-print region; specifically, a total of four switching positions are provided for moving the selector plate 32 to respective cam positions. Under the situation that the selector plate 32 is situated in a right cam position, which serves as a home position, when the carriage 23 is moved to a first switching position set in the left non-print region, the selector plate 32 moves to an intermediate cam position. Moreover, when the carriage 23 is moved further to a second switching position set outside the first switching position, the selector plate 32 is moved to the left cam position. In contrast, under the situation that the selector plate 32 is situated in the left cam position, when the carriage 23 is moved to a first restoration position set in a right non-print region, the selector plate 32 is moved to an intermediate cam position. When the carriage 23 is moved further to a second restoration position which is set outside the first restoration position and a home position of the carriage 23, the selector plate 32 is moved to the right cam position.

Various switching mechanisms which are caused to perform switching actions in accordance with movement of the selector plate 32 to a position will be described in detail with reference to the accompanying drawings.

Figure 9A:
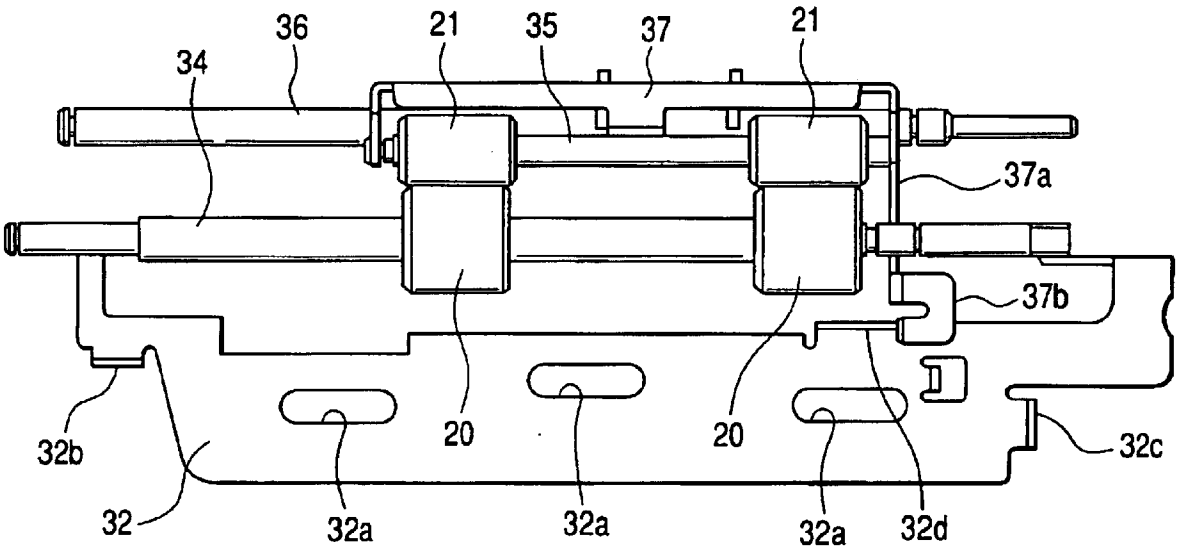
FIG. 9A is a plan view of a paper feed roller actuating mechanism, showing a closed state thereof.
Figure 9B:
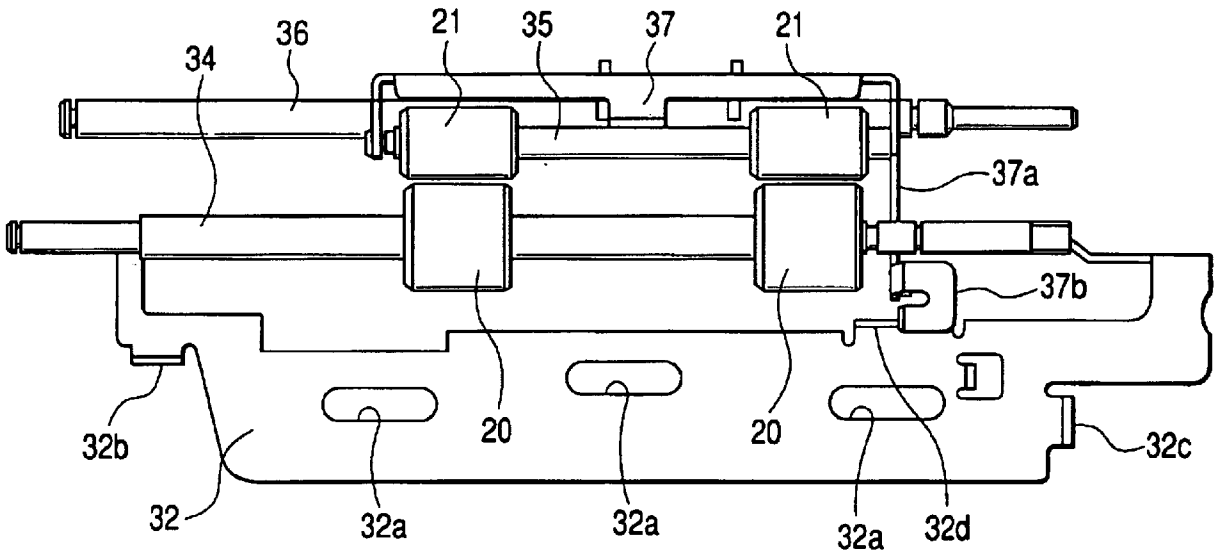
FIG. 9B is a plan view of the paper feed roller actuating mechanism, showing an open state thereof.
Figure 10A:
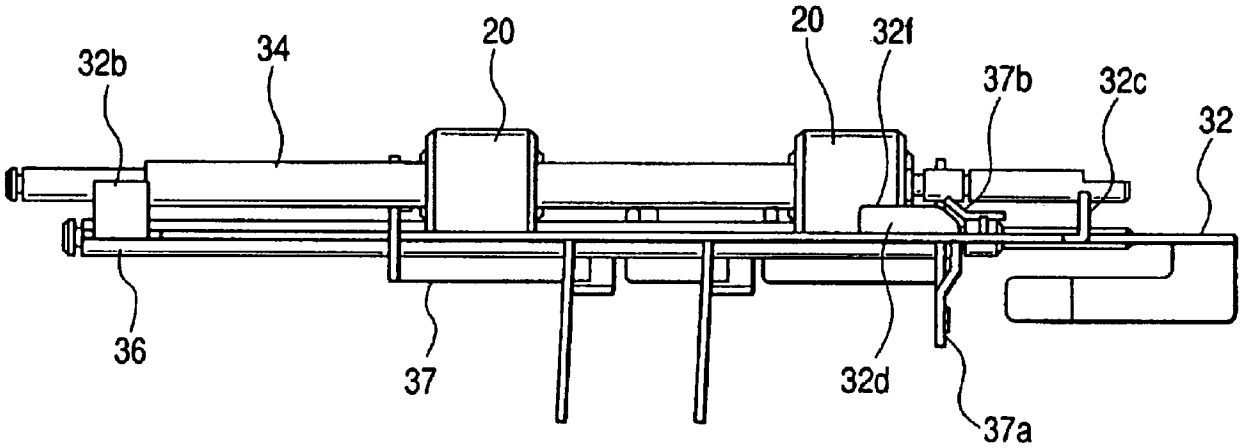
FIG. 10A is a front view of the paper feed roller actuating mechanism, showing the closed state thereof.
Figure 10B:
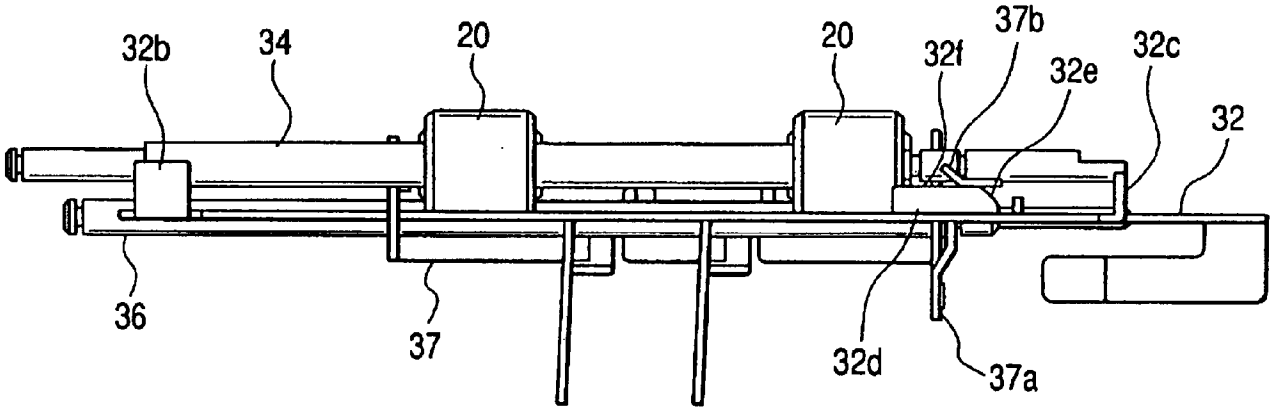
FIG. 10B is a front view of the paper feed roller actuating mechanism, showing the open state thereof.
Figure 11A:
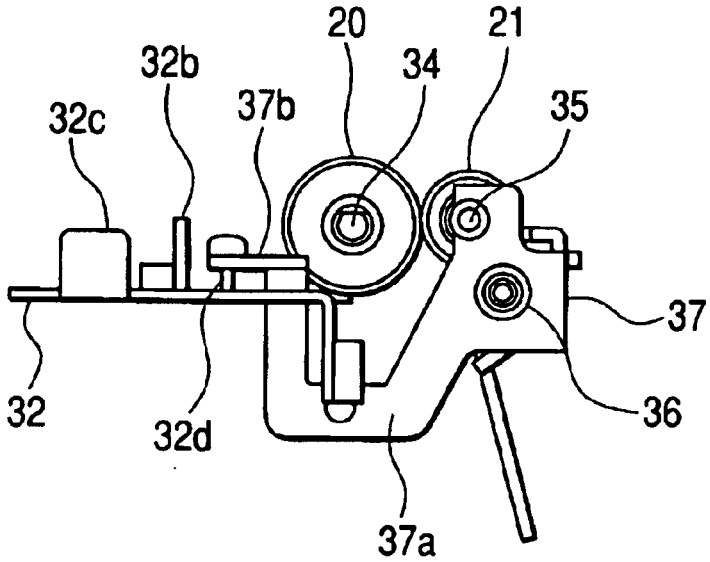
FIG. 11A is a right-side view of the paper feed roller actuating mechanism, showing the closed state thereof.
Figure 11B:
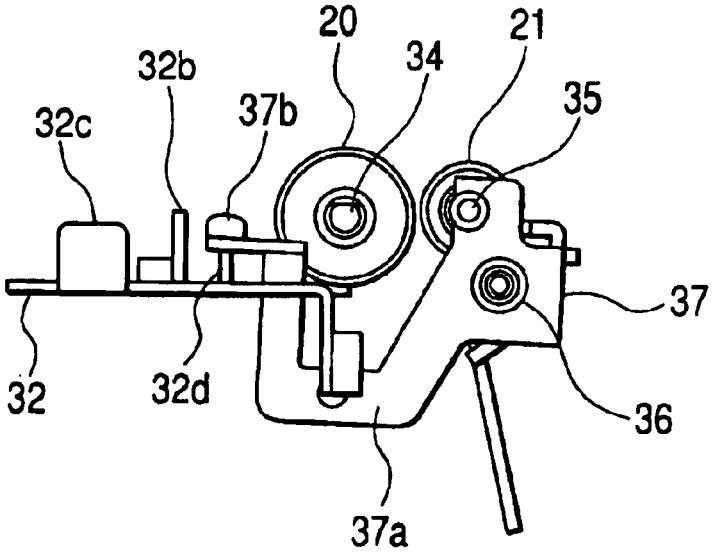
FIG. 11B is a right-side view of the paper feed roller actuating mechanism, showing the open state thereof.

FIG. 9A is a plan view of a paper feed roller actuating mechanism, showing a closed state thereof; FIG. 9B is a plan view of the paper feed roller actuating mechanism, showing an open state thereof; FIG. 10A is a front view of the paper feed roller actuating mechanism, showing the closed state thereof; FIG. 10B is a front view of the paper feed roller actuating mechanism, showing the open state thereof; FIG. 11A is a right-side view of the paper feed roller actuating mechanism, showing the closed state thereof; and FIG. 11B is a right-side view of the paper feed roller actuating mechanism, showing the open state thereof.

As illustrated, the plurality of drive rollers (i.e., stationary feed rollers) 20 are provided on a horizontally-oriented drive roller shaft 34 at predetermined intervals. The plurality of retainer rollers (movable feed rollers) 21 are provided, at predetermined intervals, on a retainer roller shaft 35 disposed ahead of and in parallel with the drive roller shaft 34. The retainer roller shaft 35 is provided on a retainer roller frame 37 which pivots while a frame spindle 36 is taken as a fulcrum. In association with pivotal movement of the retainer roller frame 37, the retainer roller shaft 35 causes the retainer rollers 21 to advance or recede with respect to the drive rollers 20. A forwardly-extending switching operation arm (switching operation member) 37*a* is formed at the right end of the retainer roller frame 37. The switching operation arm 37*a* extends forward so as to detour around a lower side of the drive roller shaft 34, and an engagement piece 37*b* formed at the extremity of the switching operation arm 37*a* is situated on the selector plate 32. A first cam piece 32*d*, which engages with the engagement piece 37*b* of the switching operation arm 37*a* in a predetermined cam position, is formed on the selector plate 32. The first cam piece 32*d* stands upright with its longitudinal direction oriented horizontally. When the selector plate 32 is situated in the left or intermediate cam position, the first cam piece 32*d* does not engage with the engagement piece 37*b* of the switching operation arm 37*a*. In this state, the retainer rollers 21 are brought into contact with the drive rollers 20 by, e.g., restoration force of a spring, whereby the space between the rollers 20, 21 is closed. In contrast, when the selector plate 32 has moved to a rightward position beyond the intermediate position, a slope section 32*e* of the first cam piece 32*d* raises the engagement piece 37*b* of the switching operation arm 37*a*. Moreover, when the selector plate 32 has reached the right cam position, the engagement piece 37*b* sits astride a flat section 32*f* of the first cam piece 32*d*. In this state, the retainer rollers 21 recede from the drive rollers 20 in association with upward pivotal movement of the switching operation arm 37*a*, thus opening up the space between the rollers 20, 21.

Since the switching operation arm 37*a* is situated on the selector plate 32 and is actuated as a result of moving astride the first cam piece 32*d*, the selector plate 32 and the switching operation arm 37*a* are arranged in an overlapping manner, thus improving layout efficiency. Moreover, reaction force of the switching operation arm 37*a* is prevented from acting in the moving direction of the selector plate 32, in turn preventing occurrence of deviation of the selector plate 32.

Figure 12A:
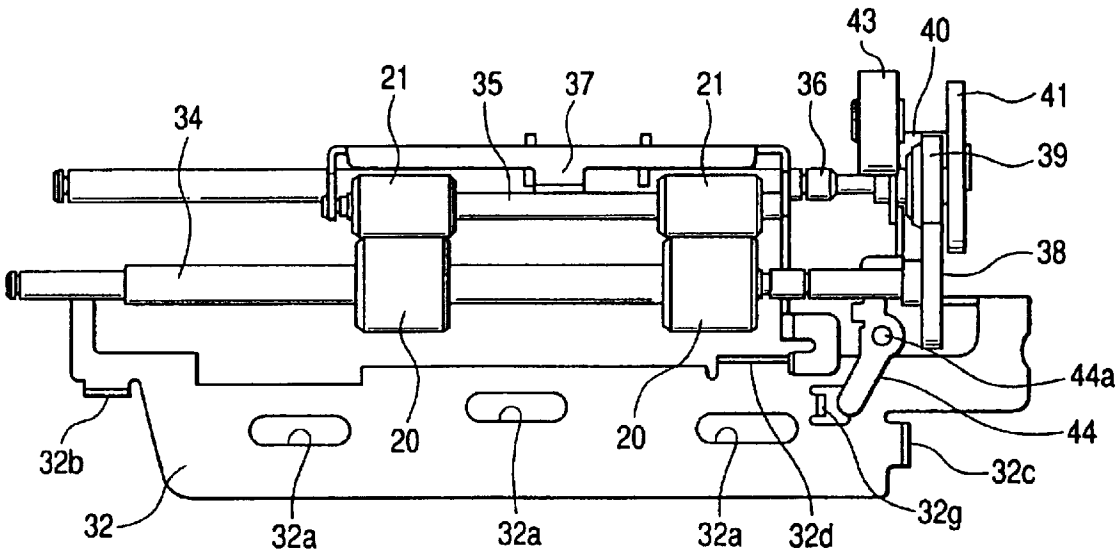
FIG. 12A is a plan view of a pump/roller switching mechanism, showing a roller driving state thereof.
Figure 12B:
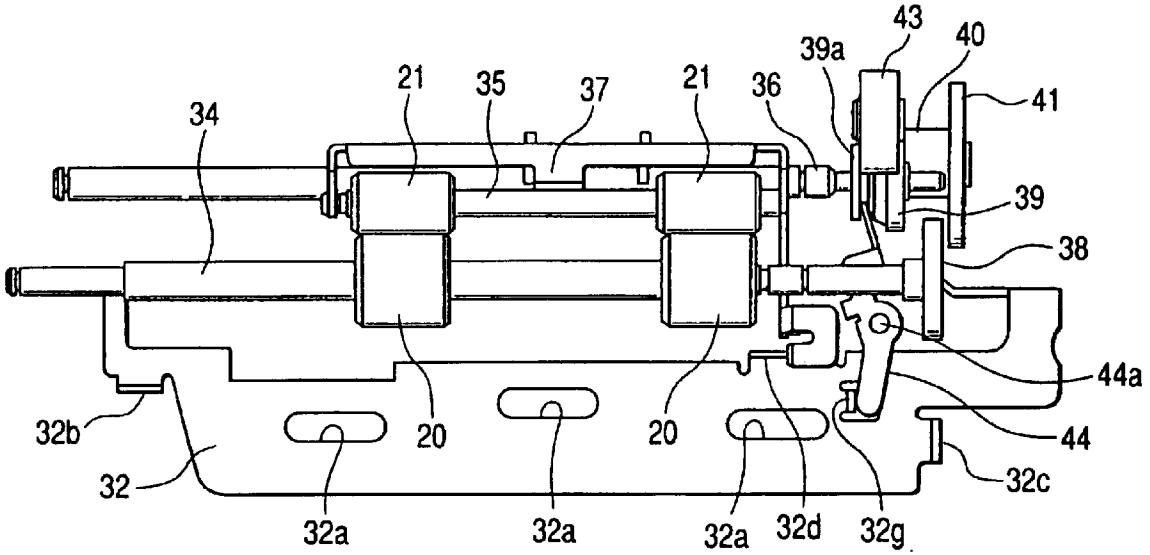
FIG. 12B is a plan view of the pump/roller switching mechanism, showing a pump driving state thereof.
Figure 13A:
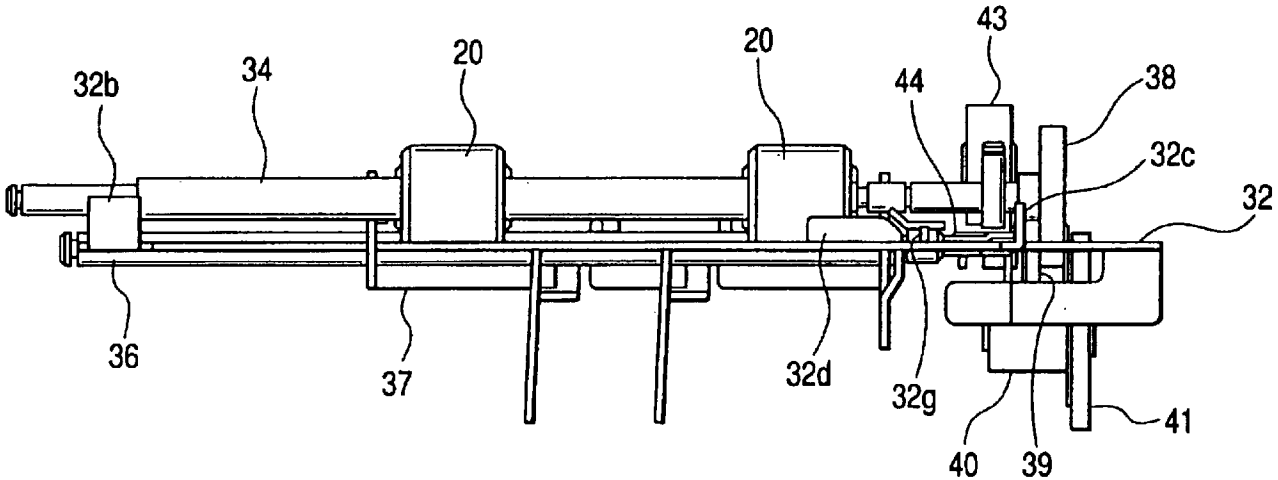
FIG. 13A is a plan view of the pump/roller switching mechanism, showing the roller driving state thereof.
Figure 13B:
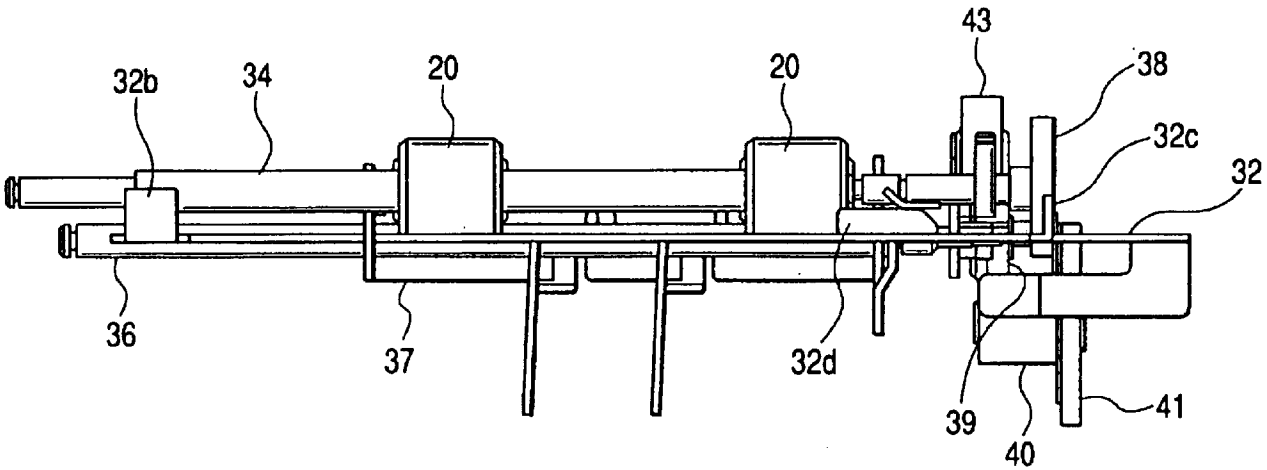
FIG. 13B is a plan view of the pump/roller switching mechanism, showing the pump driving state thereof.
Figure 14A:
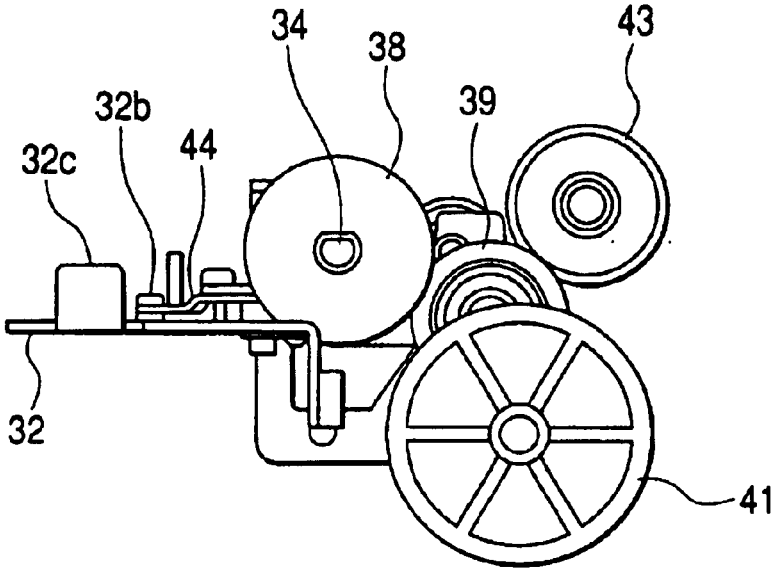
FIG. 14A is a plan view of the pump/roller switching mechanism, showing the roller driving state thereof.
Figure 14B:
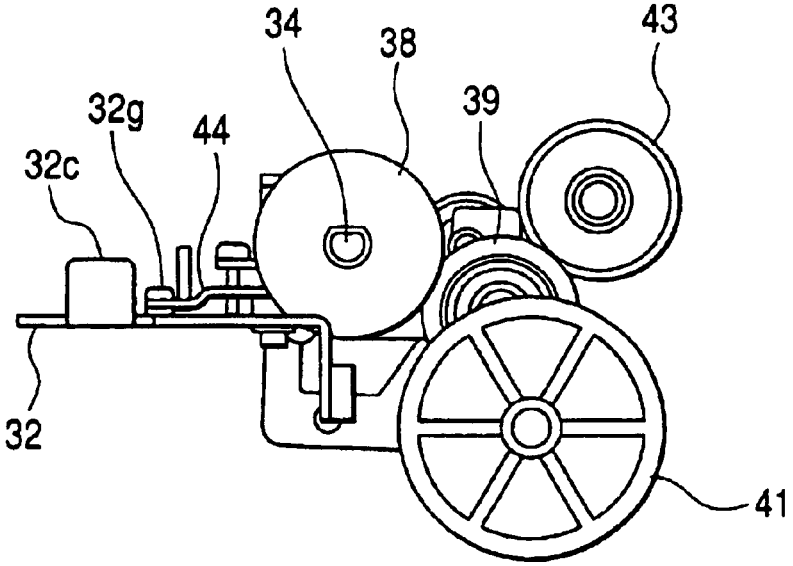
FIG. 14B is a plan view of the pump/roller switching mechanism, showing the pump driving state thereof.

FIG. 12A is a plan view of a pump/roller switching mechanism showing a roller driving state. FIG. 12B is a plan view of the pump/roller switching mechanism showing a pump driving state. FIG. 13A is a front view of the pump/roller switching mechanism showing the roller driving state. FIG. 13B is a front view of the pump/roller switching mechanism showing the pump driving state. FIG. 14A is a right-side view of the pump/roller switching mechanism showing the roller driving state. FIG. 14B is a right-side view of the pump/roller switching mechanism showing the pump driving state.

As illustrated, driving force of a paper feed motor 42 is transmitted to the drive roller shaft 34 by way of a roller drive gear (stationary gear) 38 provided integrally on the right end of the roller shaft 34; a switching gear (movable gear) 39 rotationally provided at the right end of a frame spindle 36; a wide gear 40 provided below the switching gear 39; and a power transmission gear 41 which rotates integrally with the wide gear 40. The switching gear 39 is allowed to slide along the frame spindle 36 while remaining engaged with the wide gear 40. Further, the switching gear 39 is forced rightward by an unillustrated spring (a spring for forcing a switching operation arm 44 to be described later), to thereby mesh with the roller drive gear 38. Provided in an upper left end of the wide gear 40 is a pump drive gear 43 for transmitting driving force to the ink supply pump. When the switching gear 39 has slid leftward against restoration force of the spring, the switching gear 39 meshes with the pump drive gear 43, whereby the driving force of the paper feed motor 42 is transmitted to the ink supply pump. Provided ahead of the switching gear 39 is the switching operation arm 44 which can be pivoted horizontally while an arm spindle 44*a* is taken as a fulcrum. A rear end of the switching operation arm 44 is engaged with an engagement groove 39*a* of the switching gear 39, and a front end section of the switching operation arm 44 is situated on the selector plate 32. Formed on the selector plate 32 is a second cam piece 32*g* which engages with the front end section of the switching operation arm 44 in a predetermined cam position. The second cam piece 32*g* stands upright while facing the direction perpendicular to the traveling direction of the carriage 23. When the selector plate 32 has situated at the left or intermediate cam position, the selector plate 32 does not engage with the switching operation arm 44. In this state, the switching gear 39 is meshed with the roller drive gear 38 by restoration force of the spring, whereby driving force of the drive roller shaft 34 is transmitted. When the selector plate 32 has moved to the right cam position, the second cam piece 32*g* pushes the front end of the switching operation arm 44 rightward. In association with this rightward pushing action, the rear end of the switching operation arm 44 slides the switching gear 39 leftward. In this state, the switching gear 39 meshes with the pump drive gear 43, whereby driving force is transmitted to the ink supply pump.

When interlocking of the switching gear 39 is switched, the paper feed motor 42 is driven before that switching action. As a result, there is avoided occurrence of interference, which would otherwise arise between side faces of teeth of the drive gears 38, 43 and the side faces of teeth of the switching gear 39. Smooth interlocking and prevention of interlocking failures are achieved.

Figure 15A:
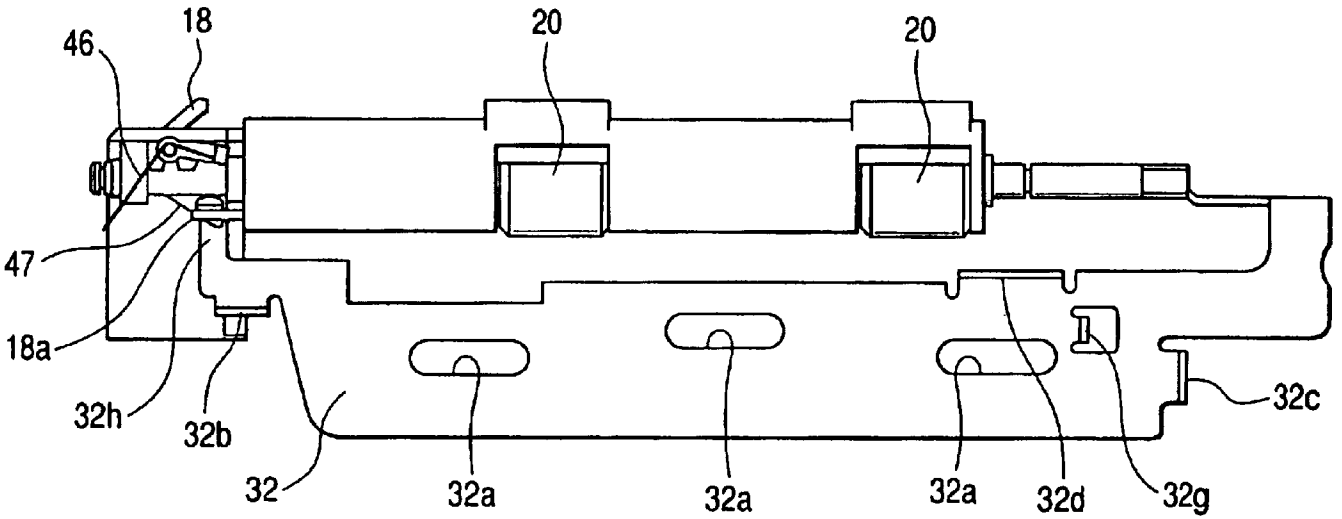
FIG. 15A is a plan view of a positioning stopper actuating mechanism, showing a projected state thereof.
Figure 15B:
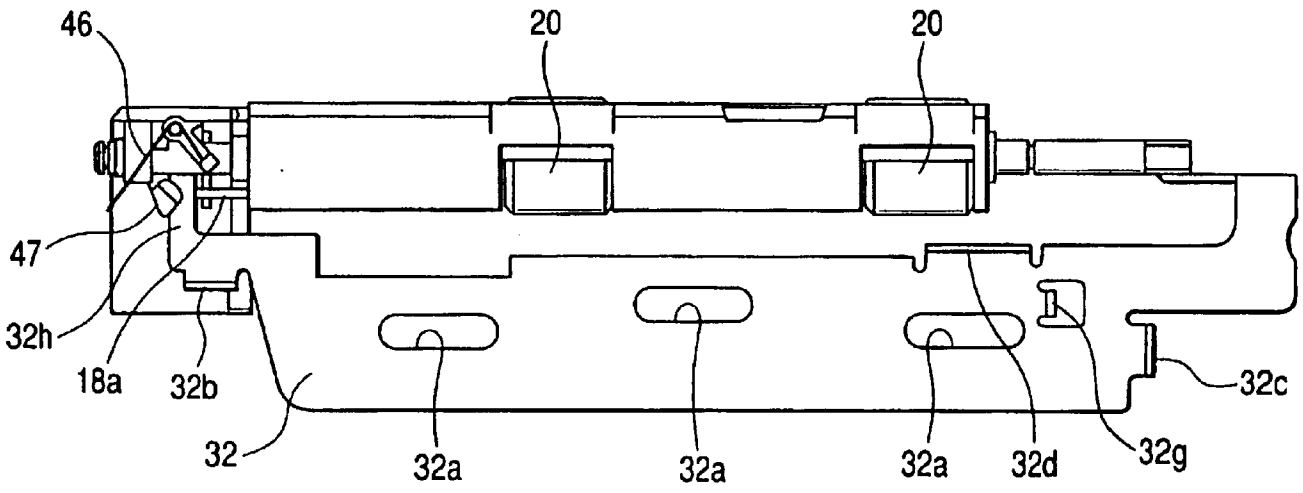
FIG. 15B is the plan view of the positioning stopper actuating mechanism, showing a retracted state thereof.
Figure 16A:
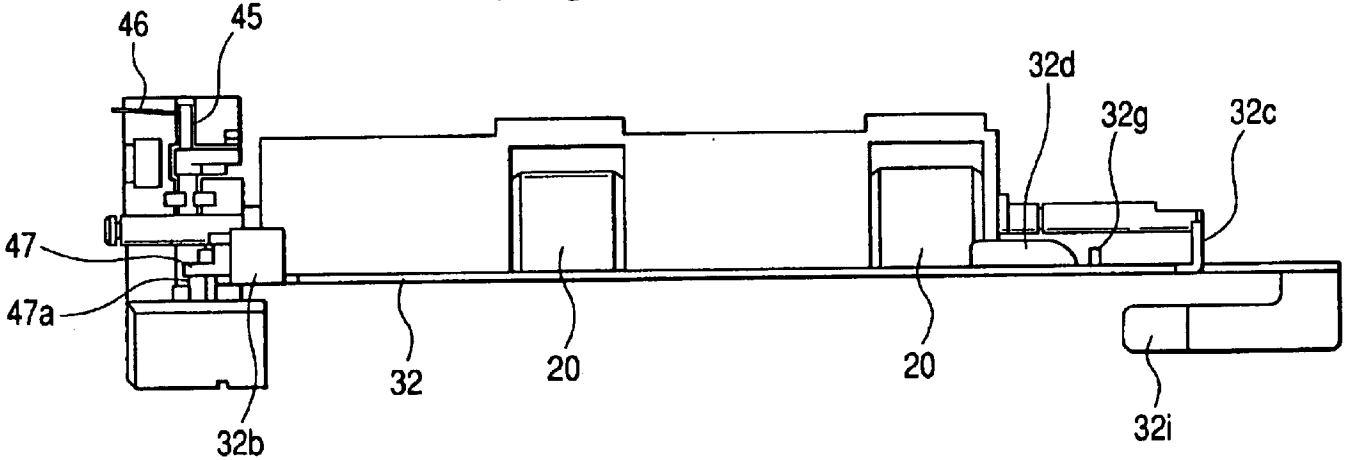
FIG. 16A is a plan view of the positioning stopper actuating mechanism, showing the projected state thereof.
Figure 16B:
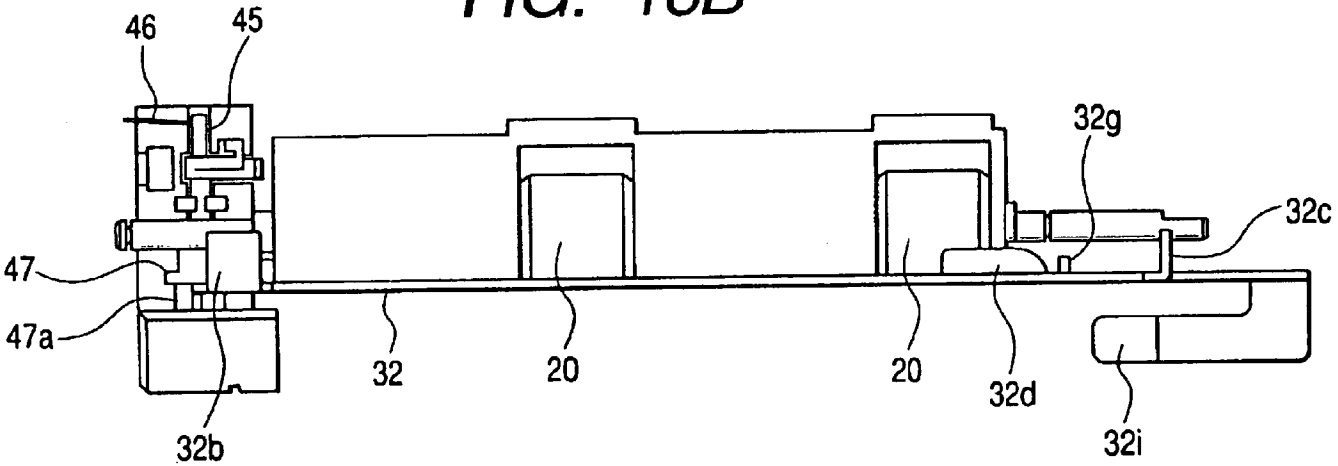
FIG. 16B is a plan view of the positioning stopper actuating mechanism, showing the retracted state thereof.
Figure 17A:
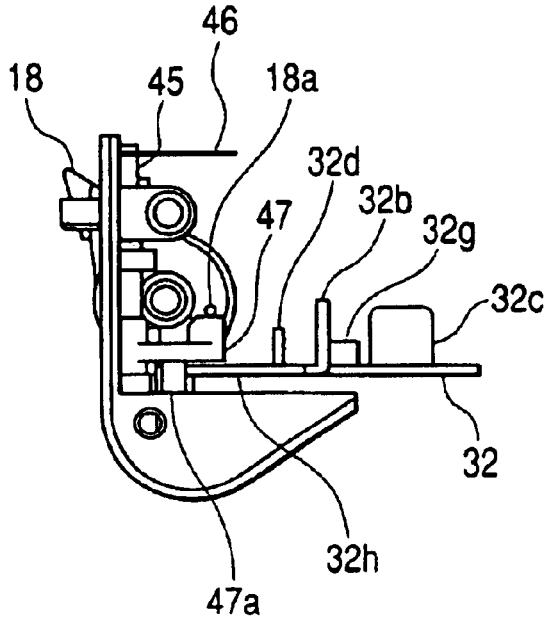
FIG. 17A is a left-side view of the positioning stopper actuating mechanism, showing the projected state thereof.
Figure 17B:
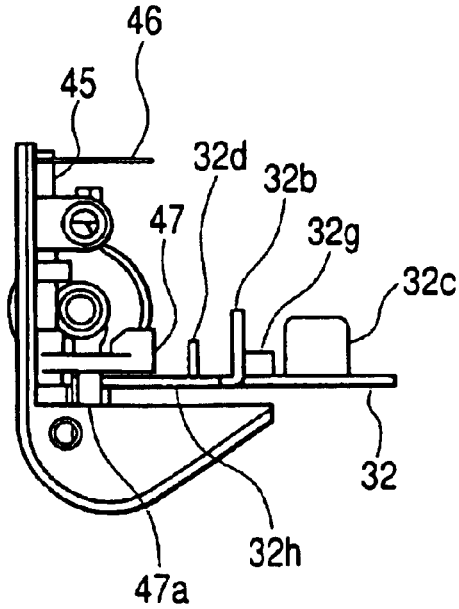
FIG. 17B is a left-side view of the positioning stopper actuating mechanism, showing the retracted state thereof.

FIG. 15A is a plan view of a positioning stopper actuating mechanism, showing a projected state of a positioning stopper. FIG. 15B is a plan view of the positioning stopper actuating mechanism, showing a retracted state of the positioning stopper. FIG. 16A is a front view of the positioning stopper actuating mechanism, showing the projected state. FIG. 16B is a front view of the positioning stopper actuating mechanism, showing the retracted state. FIG. 17A is a left-side view of the positioning stopper actuating mechanism, showing the projected state. FIG. 17B is a left-side view of the positioning stopper actuating mechanism, showing the retracted state.

As illustrated, the positioning stopper 18 is provided so as to be pivotable back and forth about the drive roller shaft 34 and projects into the paper transporting path 13, by restoration force of an unillustrated spring. An engagement projection 18*a* projecting leftward is formed at the left end of the positioning stopper 18. A forwardly-extending switching operation arm 47 is formed integrally with a lower end of a pivotal shaft 45 which is to be oriented vertically. An engagement projection 47*a* is projectingly formed on the lower face of the switching operation arm 47. Formed on the selector plate 32 is a third cam piece 32*h* which engages with an engagement projection 47*a* of the switching operation arm 47 in a predetermined cam position. When the selector plate 32 is situated in the right cam position, the third cam piece 32*h* does not engage with the engagement projection 47*a* of the switching operation arm 47. In this state, the positioning stopper 18 projects into the paper transporting path 13 by restoration force of an unillustrated spring. The switching operation arm 47 moves under the lower face of the engagement projection 18*a* by restoration force of the spring 46 and is located by the positioning stopper 18. When the paper P is situated on the positioning stopper 18, the positioning stopper 18 is not locked even in this state. When the paper P has been passed, the positioning stopper 18 projects into the paper transporting path 13. Further, the switching operation arm 47 moves under the lower face of the engagement projection 18*a*, and the positioning stopper 18 is locked. In contrast, when the selector plate 32 is situated at the left or intermediate cam position, the third cam piece 32*h* pushes the engagement projection 47*a* of the switching operation arm 47 to the left. In this state, the switching operation arm 47 pivots and is disengaged from the engagement projection 18*a*, thereby rendering the positioning stopper 18 pivotable. In this state, when the paper P is inserted, the leading end of the paper P rotates the positioning stopper 18 toward the retracted position, thereby opening the paper transporting path 13.

Figure 18A:
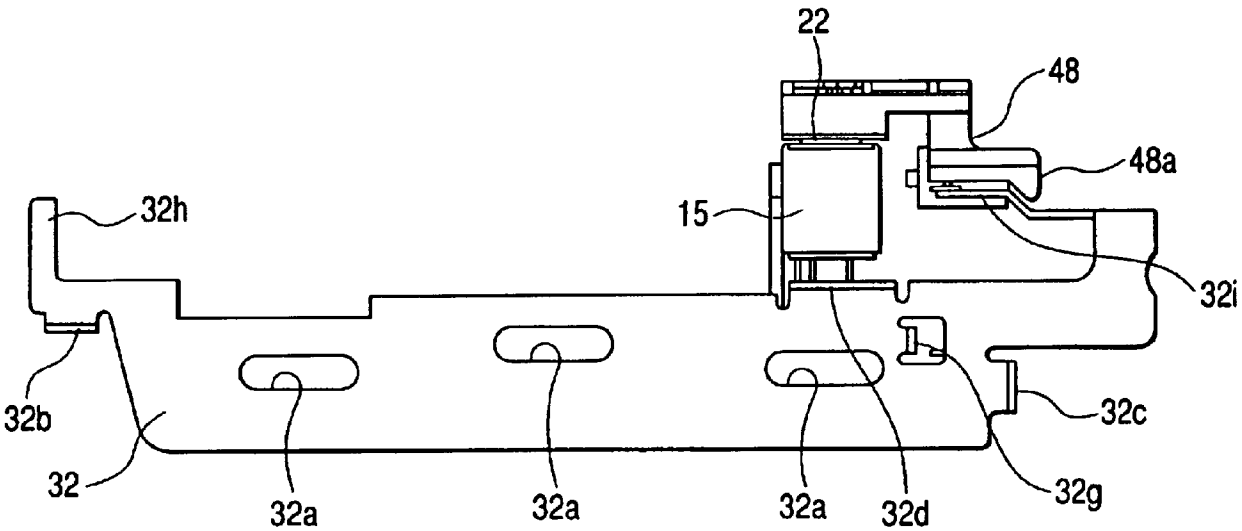
FIG. 18A is a plan view of an MICR actuating mechanism, showing a closed state thereof.
Figure 18B:
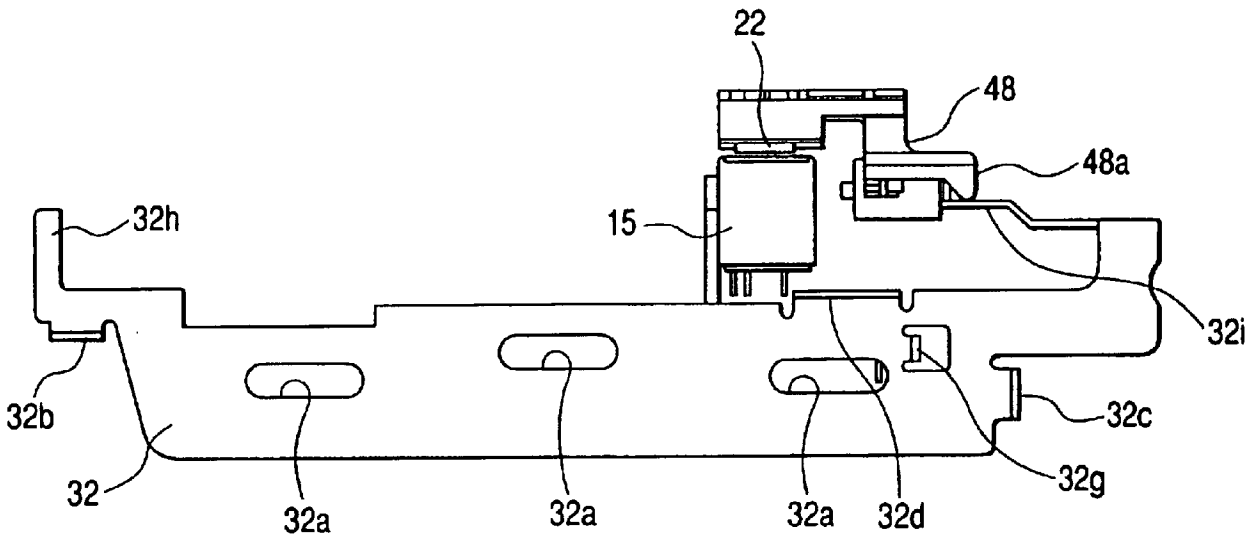
FIG. 18B is a plan view of the MICR actuating mechanism, showing an open state thereof.
Figure 19A:
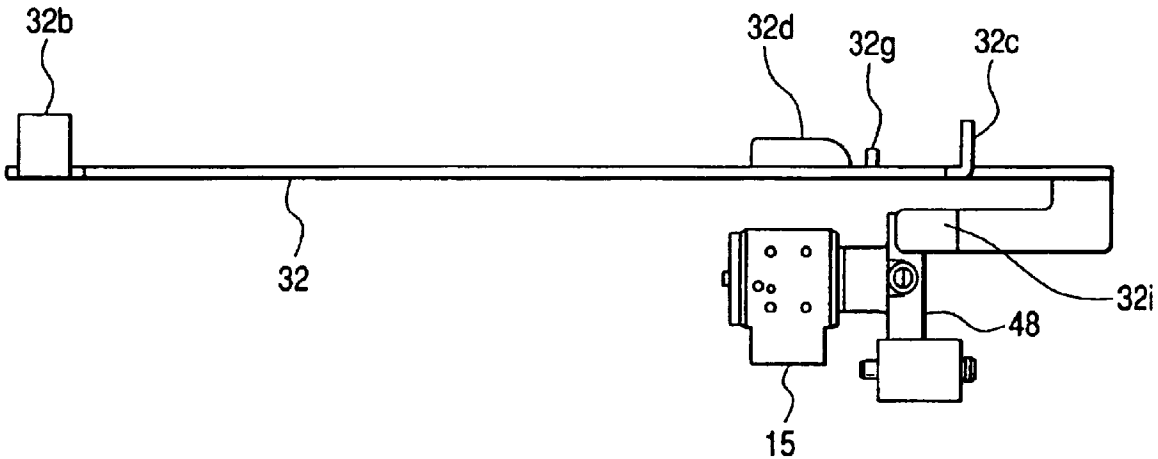
FIG. 19A is a plan view of the MICR actuating mechanism, showing the closed state thereof.
Figure 19B:
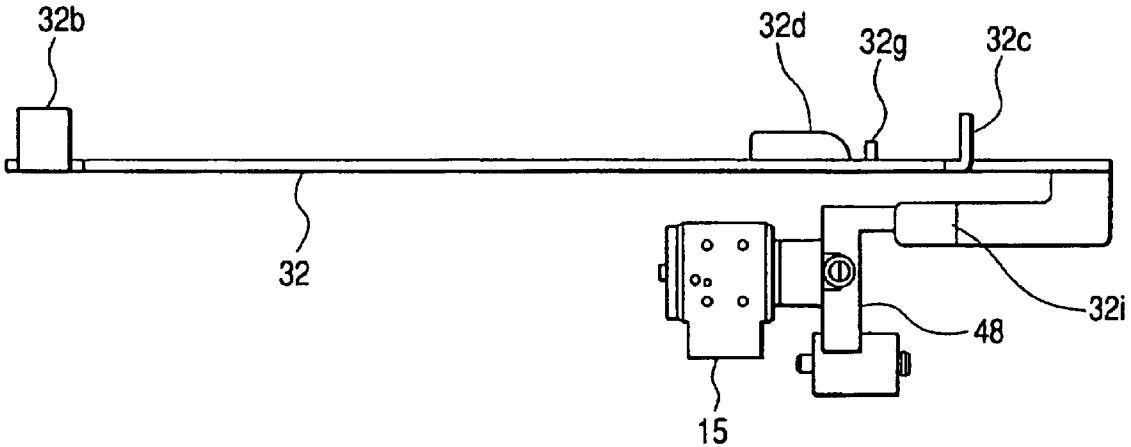
FIG. 19B is a plan view of the MICR actuating mechanism, showing the open state thereof.
Figure 20A:
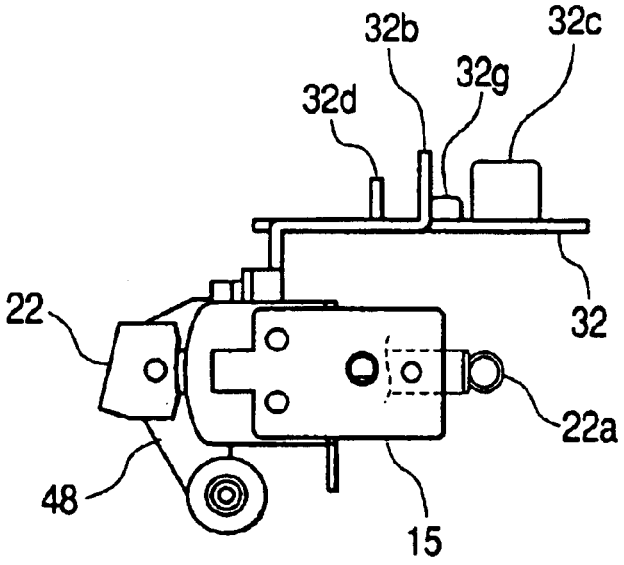
FIG. 20A is a left-side view of the MICR actuating mechanism, showing the closed state thereof.
Figure 20B:
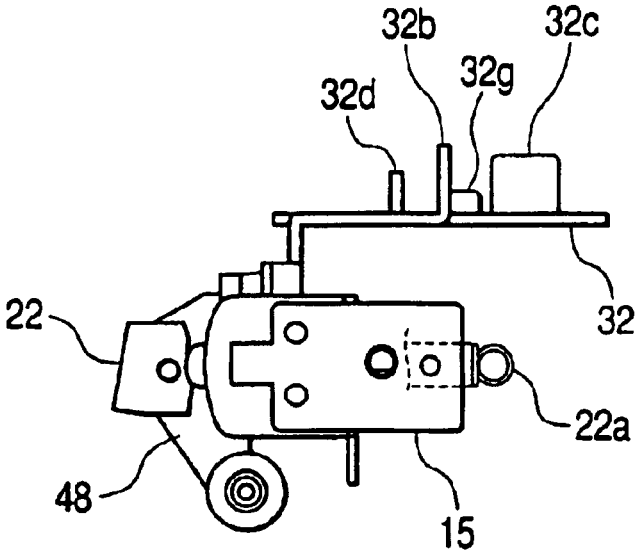
FIG. 20B is a left-side view of the MICR actuating mechanism, showing the open state thereof.
Figure 21A:
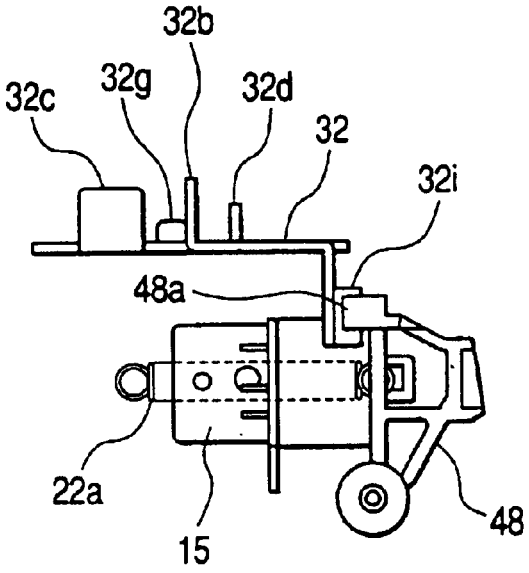
FIG. 21A is a right-side view of the MICR actuating mechanism, showing the closed state thereof.
Figure 21B:
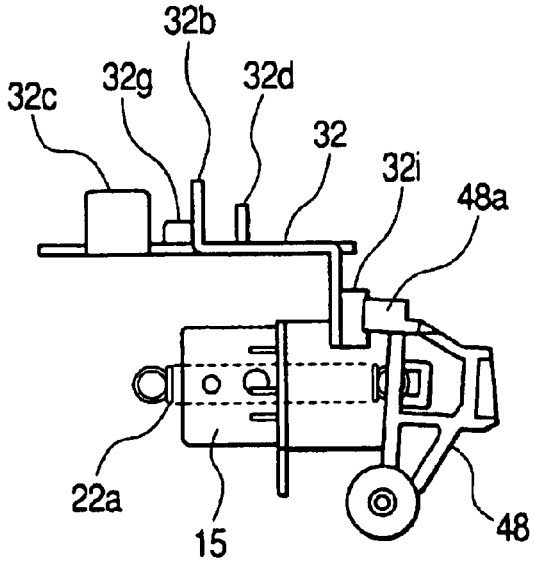
FIG. 21B is a right-side view of the MICR actuating mechanism, showing the open state thereof.

FIG. 18A is a plan view of an MICR actuating mechanism, showing a closed state thereof. FIG. 18B is a plan view of the MICR actuating mechanism, showing an open state thereof. FIG. 19A is a front view of the MICR actuating mechanism, showing the closed state thereof. FIG. 19B is a front view of the MICR actuating mechanism, showing the open state thereof. FIG. 20A is a left-side view of the MICR actuating mechanism, showing the closed state thereof. FIG. 20B is a left-side view of the MICR actuating mechanism, showing the open state thereof. FIG. 21A is a right-side view of the MICR actuating mechanism, showing the closed state thereof. FIG. 21B is a right-side view of the MICR actuating mechanism, showing the open state thereof. As shown in the drawings, the retainer 22 is provided integrally on a switching operation arm 48 which is pivotable back and forth while a lower end thereof is taken as a fulcrum. The retainer 22 is brought into contact with the MICR head 15 by restoration force of the spring 22*a*. An upper end of the switching operation arm 48 protrudes rightward, and a forwardly-projecting engagement projection 48*a* is formed at the extremity of the thus-protruding upper end. Formed on the selector plate 32 is a fourth cam piece 32*i* which engages with the engagement protuberance 48*a* of the switching operation arm 48 at a predetermined cam position. The fourth cam piece 32*i* is formed such that the extremity of the fourth cam piece projects rearward. When the selector plate 32 is situated in the left cam position, the fourth cam piece 32*i* is situated along the upper end of the switching operation arm 48 but does not engage with the engagement projection 48*a*. In this state, the retainer 22 is brought into contact with the MICR head 15 by restoration force of the spring 22*a*. In contrast, when the selector plate 32 is situated at the intermediate or right cam position, the fourth cam piece 32*i* engages with the engagement projection 48*a*, thereby pushing the switching operation arm 48 rearward. In this state, in association with reverse pivotal movement of the switching operation arm 48, the retainer 22 recedes from the MICR head 15, thus clearing the paper transporting path 13.

FIG. 22 is a table showing the statuses of the switching mechanisms when staying at the respective cam positions. FIG. 23 is a chart showing operation timings of the switching mechanism. As shown in the drawings, when the selector plate 32 is situated at the right cam position (home position), the pump/roller switching mechanism is brought into a pump driving state; the paper feed roller actuating mechanism is brought into an open state; the positioning stopper actuating mechanism is brought into a projecting state; and the MICR mechanism is brought into an open state.

Next, when the selector plate 32 is situated at the intermediate cam position, the pump/roller switching mechanism is brought into a roller driving state; the paper feed roller actuating mechanism is brought into a closed state; the positioning stopper actuating mechanism is brought into a retractable state; and the MICR actuating mechanism is brought into a closed state. In other words, in the situation that the selector plate 32 is situated at the right cam position, if the carriage 23 has been moved to the first switching position, the selector plate 32 is moved to the intermediate cam position, thereby switching the pump/roller switching mechanism, the paper feed roller actuating mechanism, and the positioning stopper actuating mechanism.

Further, when the carriage 23 is moved to the second switching position, the selector plate 32 is moved to the left cam position, whereby the MICR actuating mechanism is switched.

In contrast, in the situation that the selector plate 32 is situated at the left cam position, when the carriage 23 is moved to the first restoration position, the selector plate 32 moves to the intermediate cam position, so that the MICR actuating mechanism is restored from the closed state to an open state. Further, when the carriage 23 is moved to the second restoration position, which is a home position of the carriage, the selector plate 32 is moved to the right cam position, thereby effecting restoration of the pump/roller switching mechanism to the pump driving state, restoration of the paper feed roller actuating mechanism to the open state, and restoration of the positioning stopper actuating mechanism to the projected state.

In summary, the carriage 23 switches the paper feed roller actuating mechanism and the MICR actuating mechanism between different switching positions and causes them to restore their switched states at different restoration positions. Therefore, the paper feed roller actuating mechanism and the MICR actuating mechanism can be opened or closed in similar manners. Moreover, the paper feed roller actuating mechanism can be closed while the MICR actuating mechanism is opened. For example, the MICR actuating mechanism is brought into an open state while the paper feed roller actuating mechanism remains closed; or the paper feed roller actuating mechanism is brought into a closed state while the MICR actuating mechanism remains closed. Consequently, switching control operations can be performed in accordance with the kind of paper P and processing steps.

In the embodiment, the first and second restoration positions are set in locations close to the home position of the carriage 23. Therefore, all the switching mechanisms can be initialized, by merely returning the carriage 23 to its home position, thereby shortening the time required by initialization processing which involves a necessity to restore switching statuses of the respective switching mechanisms.

Figure 24:
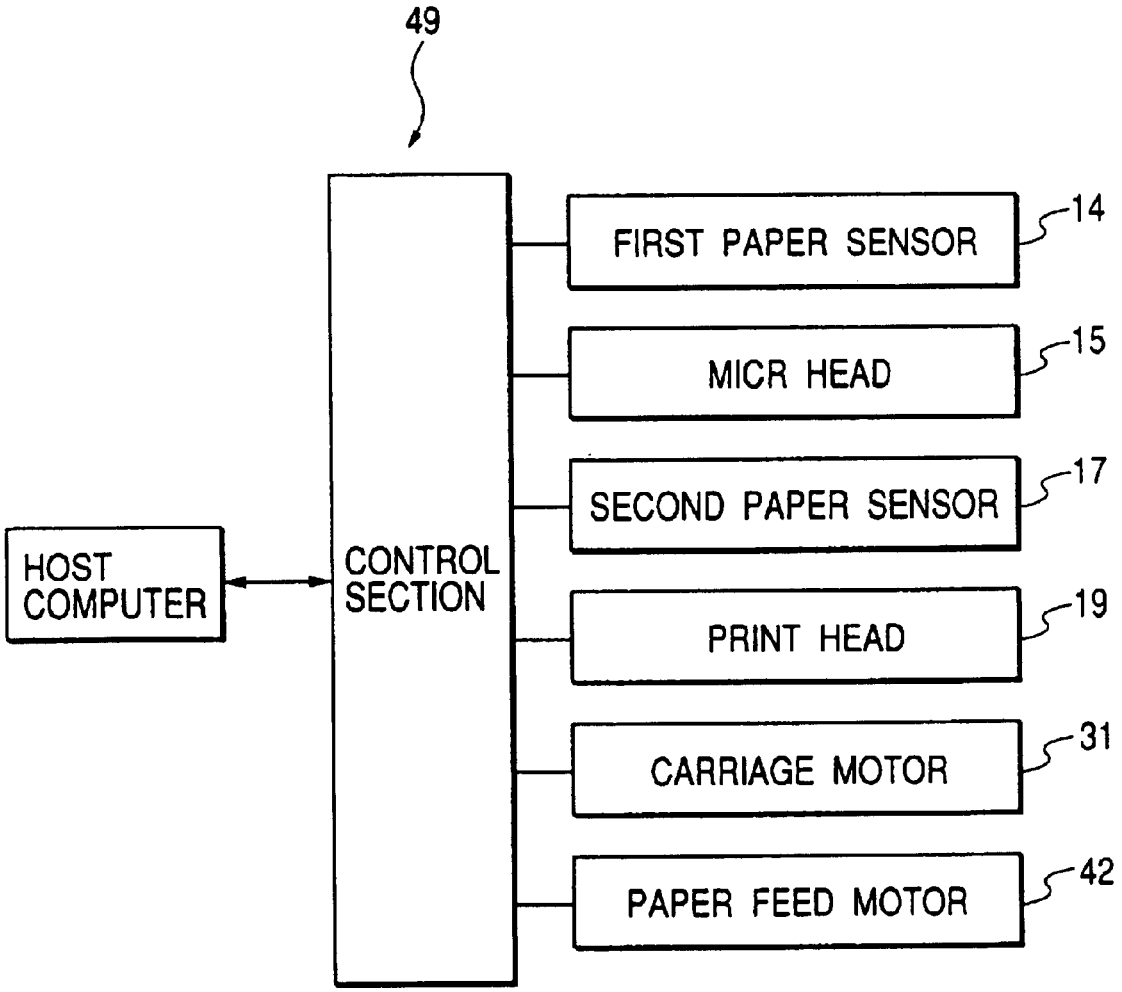
FIG. 24 is a block diagram showing a control section.

As shown in FIG. 24, the printer 10 has a control section 49 comprising a CPU, ROM, RAM, or a like element. Connected to the control section 49 are the previously-described first paper sensor 14, the MICR head 15, the second paper sensor 17, the print head 19, the carriage motor 31, and the paper feed motor 42. By reference to a flowchart, there will now be described control procedures pertaining to a cut sheet print control operation and check print control operation, which are to be executed by the control section 49.

Figure 25:
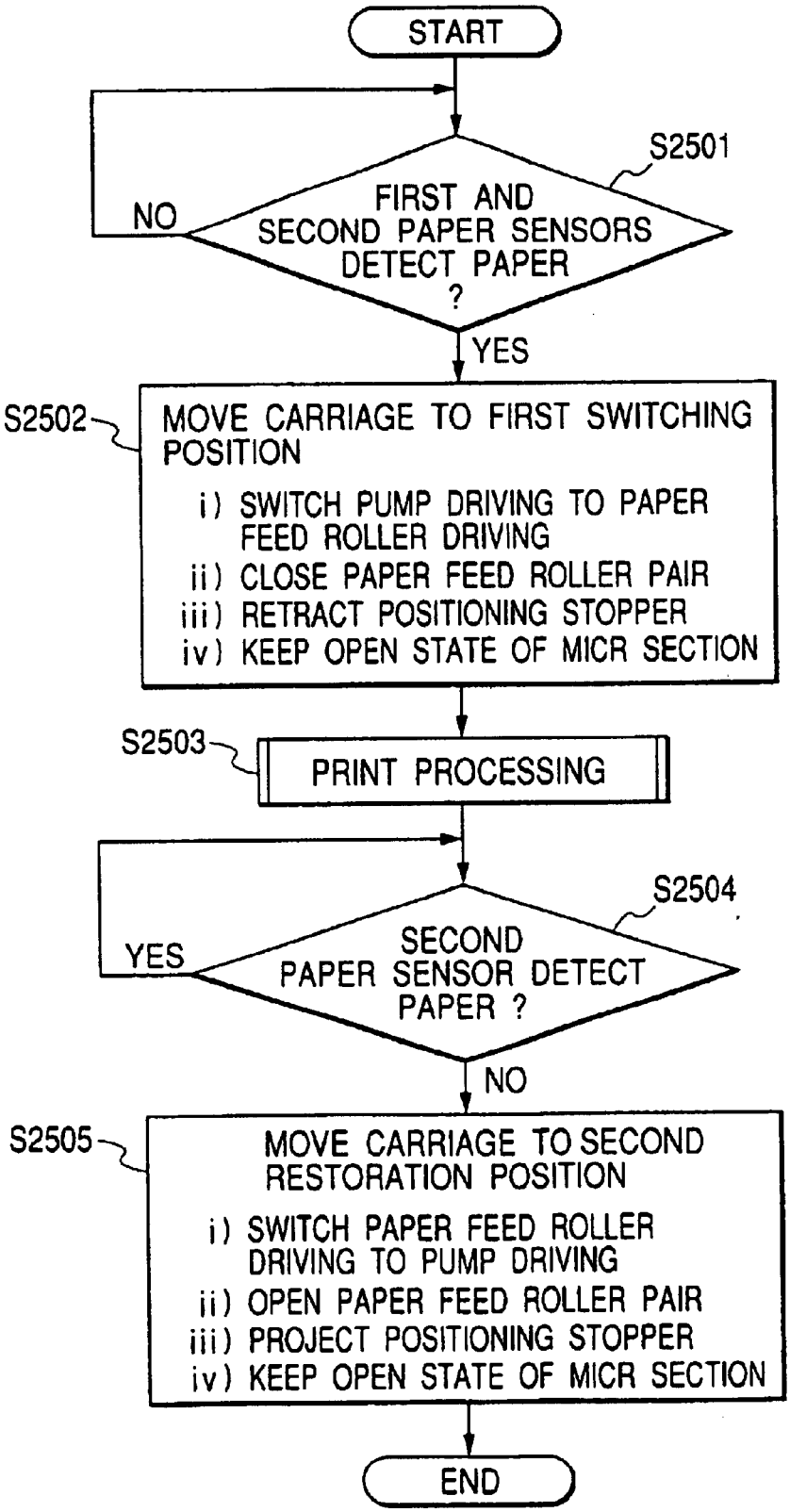
FIG. 25 is a flowchart showing a cut sheet printing control operation.

FIG. 25 is a flowchart showing a cut sheet print control operation. The control is carried out in response to receipt of a cut sheet print command. Upon receipt of a cut sheet print command, insertion of a cut sheet is awaited. At this time, the pump/roller switching mechanism remains in a pump driving state; the paper feed roller actuating mechanism remains open; the positioning stopper actuating mechanism remains projected; and the MICR actuating mechanism remains open. When a cut sheet is inserted by way of the insertion slot 11, insertion of a cut sheet is determined on the basis of sensor signals output from the first and second paper sensors 14, 17 (S2501), thereby moving the carriage 23 to the first switching position (S2502). As a result, the pump/roller switching mechanism is switched to a roller driving state; the paper feed roller actuating mechanism is switched to a closed state; and the positioning stopper actuating mechanism is switched to a retracted state, while keeping the MICR actuating mechanism open. Next, a printing operation (S2503) is carried out while the cut sheet is being fed. Subsequently, pulling out of the cut sheet is awaited while the rear end of the printed cut sheet is supported by the pair of paper feed rollers 16. In accordance with the sensor signal output from the second paper sensor 17, pulling out of the cut sheet is determined (S2504). Then, the carriage 23 is moved to the second restoration position (S2505), thus completing a single cut print control operation.

As a result, the pump/roller switching mechanism is restored to the pump driving state; the paper feed roller actuating mechanism is restored to the open state; and the positioning stopper actuating mechanism is restored to the projected state. Thus, the printer 10 restores an initial state in which insertion of a cut sheet can be awaited.

Figure 26:
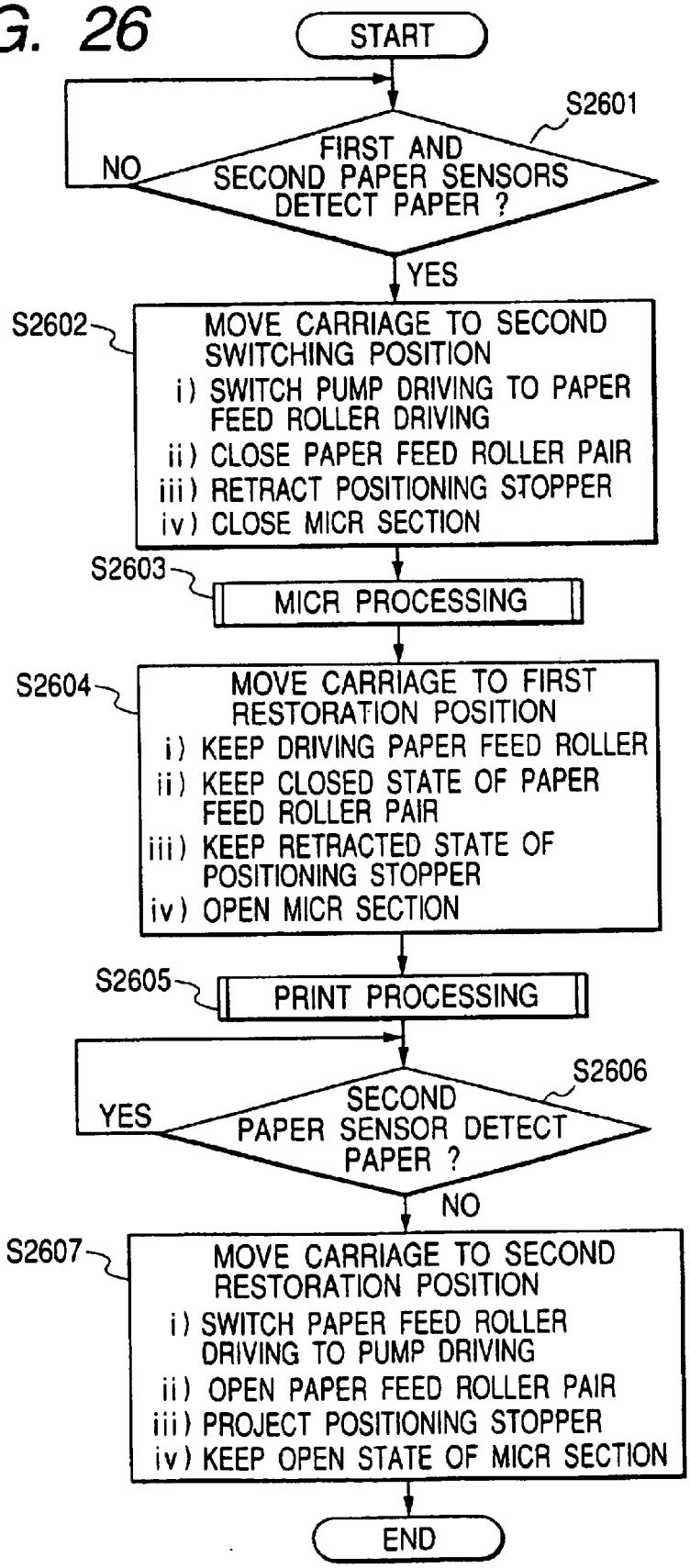
FIG. 26 is a flowchart showing a check printing control operation.

FIG. 26 is a flowchart showing check print control operation. The control operation is performed in response to receipt of a check print command.

When a check print command is received, insertion of a check is first awaited.

At this time, the pump/roller switching mechanism remains in the pump driving state; the paper feed roller actuating mechanism remains open; the positioning stopper actuating mechanism remains projected; and the MICR actuating mechanism remains open.

When a check is inserted by way of the insertion slot 11, insertion of a check is determined on the basis of the sensor signals output from the first and second paper sensors 14, 17 (S2601), thereby moving the carriage 23 toward the second switching position (S2602). As a result, the pump/roller switching mechanism is switched to a roller driving state; the paper feed roller actuating mechanism is switched to a closed state; the positioning stopper actuating mechanism is switched to a retracted state; and the MICR actuating mechanism is switched to the closed state.

Next, an MICR operation is performed while the check is being fed (S2603). Subsequently, the carriage 23 is moved to the first restoration position (S2604). As a result, only the MICR actuating mechanism remains open. Next, a printing operation is performed while the check is being fed by rotating the drive rollers 20 (S2605). Pulling out of the check is awaited while the rear end of the printed check is supported on the plurality of paper rollers 16. When pulling out of the check is determined in accordance with the sensor signal output from the second paper sensor 17 (S2606), the carriage 23 is moved to the second restoration position (S2607), and the check print control operation is terminated.

Thereby, the pump/roller switching mechanism restores the pump driving state; the paper feed roller actuating mechanism restores an open state; and the positioning stopper actuating mechanism restores a projected state. Thus, the printer restores the initial state in which awaiting for insertion is possible.

In connection with the previously-described cut sheet print control operation and the check print control operation, when the pump/roller switching mechanism is switched, the paper feed motor 42 is driven before the selector plate 32 is actuated by the carriage 23, for preventing occurrence of meshing failures between the drive gear 38, 43 and the switching gear 39.

According to the embodiment as described above, the plurality of switching mechanisms are actuated by utilization of operating force of the carriage 23. Hence, use of a solenoid of actuating the respective switching mechanisms is obviated, thereby enabling a reduction in the number of parts and simplification and power conservation of an electric circuit.

A plurality of positions are set in each of the non-print regions of the carriage 23. Since the selector plate 32 is actuated to and retained at the three or more cam positions in accordance with movement of the carriage 23 to the respective positions, at least one of the switching mechanisms can be selectively actuated. Consequently, there can be performed switching control operations which are comparable to those performed when respective switching mechanisms are provided with solenoids.

Next, a positioning stopper actuating mechanism according to a second embodiment of the present invention will now be described by reference to FIGS. 27A through 28B. In the description, those mechanisms identical with those described in connection with the first embodiment are denoted by the same reference numerals as used in the first embodiment.

Figure 27A:
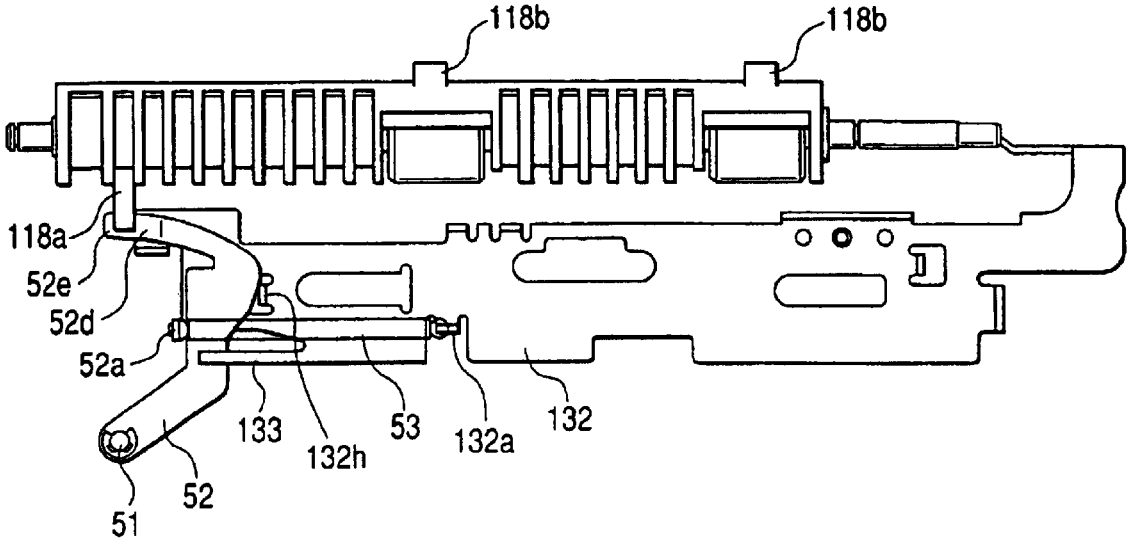
FIG. 27A is a plan view of a positioning stopper actuating mechanism according to a second embodiment of the invention, showing a projected state thereof.
Figure 27B:
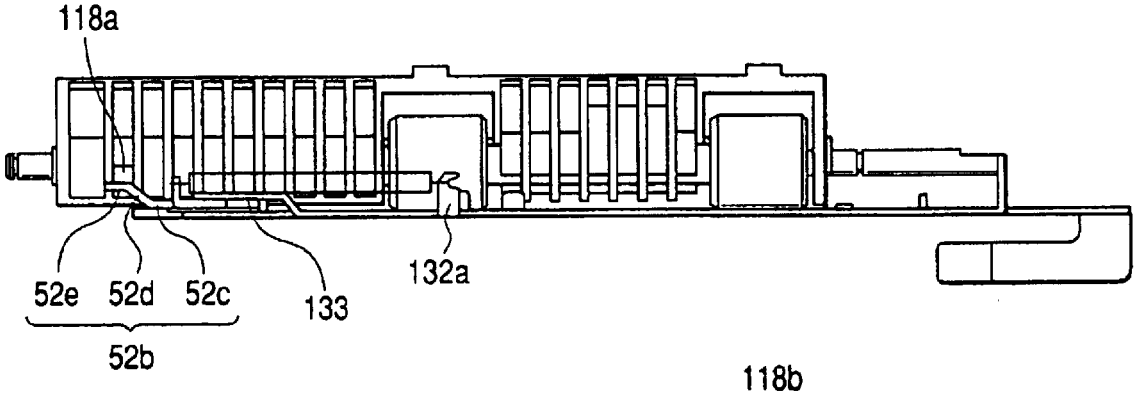
FIG. 27B is a front view of the positioning stopper actuating mechanism of FIG. 27A.
Figure 27C:
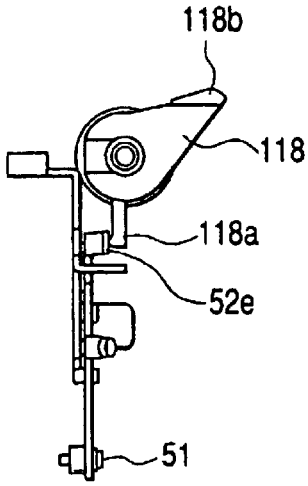
FIG. 27C is a side view of the positioning stopper actuating mechanism of FIG. 27A.
Figure 28A:
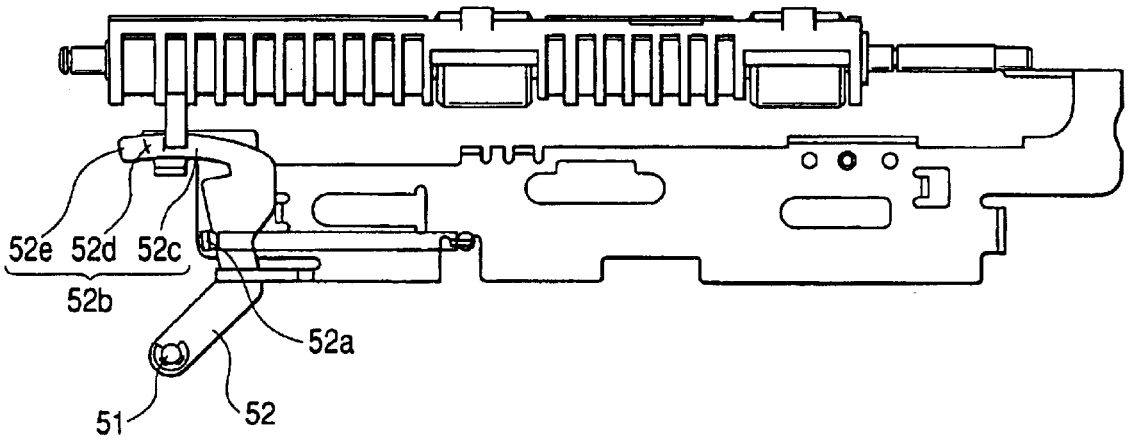
FIG. 28A is a plan view of the positioning stopper actuating mechanism according to the second embodiment of the invention, showing a retracted state thereof.
Figure 28B:
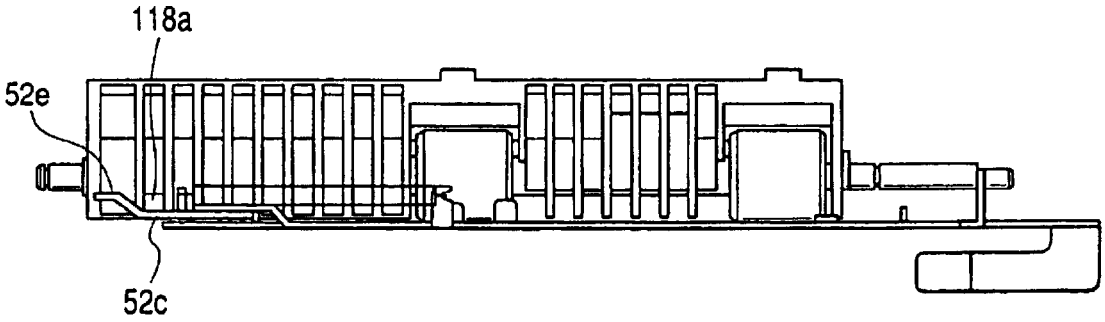
FIG. 28B is a front view of the positioning stopper actuating mechanism of FIG. 28A.

FIGS. 27A to 27C are descriptive views in which a selector plate 132 is situated in a right cam position. FIGS. 28A and 28B are descriptive views of an intermediate cam position.

A positioning stopper 118 is attached while having a function substantially equal to that of the positioning stopper 18, except that the stopper 118 is equipped integrally with a stationary arm 118*a* in place of an engagement section 18*a* of the positioning stopper 18. Similarly, the selector plate 132 is attached while having the function as that of the selector plate 32, except that a functional difference exists between the third cam piece 32*h* and the third cam piece 132*h*.

As illustrated, an operation lever 52 is pivotally attached to a support shaft 51 provided on the carriage frame 28 (see FIG. 1). A center portion of the operation lever 52 is secured such that vertical movement of the center portion is restricted by an upper face of the selector plate 132 and a regulation section 133 constituted of a portion of the selector plate 132. The operation lever 52 is forced so as to come into contact with the third cam piece 132*h*, by a tensile coil spring 53 routed around a spring latch section 52*a* and a spring latch section 132*a* of the selector plate 132. A cam section 52*b* (52*c*, 52*d*, 52*e*) which comes into contact with the stationary arm 118*a* is provided on the portion of the operation lever 52.

A switching mechanism, which switchably actuates the positioning stopper actuating mechanism in accordance with the position and movement of the selector plate 132, will be described in detail by reference to the drawings.

When the selector plate 132 is situated in the right cam position, as shown in FIGS. 27A and 27B, the operation lever 52 retains the stationary arm 118*a* by use of a stationary section 52*e* located in an elevated position. In this state, the positioning stopper 118 is locked in an initial state in which an end section 118*b* remains projected into the paper transporting path 13.

Next, when the selector plate 132 is moved to the intermediate cam position, the operation lever 52 is pivoted about the support shaft 51 by the third cam piece 132*h*. Consequently, a cam section 52*b* corresponding to the stationary arm 118*a* is moved to a lower release section 52*c* by way of a slope section 52*d*. The stationary arm 118 becomes pivotable correspondingly. When the paper P is inserted into the paper transporting path 13 in this state, as shown in FIGS. 28A and 28B, the end section 118*b* of the positioning stopper 118 is pivoted to an retracted position by the leading end of the paper P, thereby opening the paper transporting path 13.

As in the case of the intermediate cam position, even when the selector plate 132 has moved to the left cam position, the cam section 52*b* is switched to the release section 52*c*, whereby the paper transporting path 13 remains open.

Next, when the selector plate 132 has been moved, by the carriage 23, to the right cam position, which is the home position for the plate 132, the operation lever 52 is pivoted about the support shaft 51 so as to come into contact with the third cam piece 132*h* by the tensile coil spring 53. The stationary section 52*e* of the cam section 52*b* runs below the lower face of the stationary arm 118*a*, and the positioning stopper 118 is locked in an initial state in which an end section 118*b* projects into the paper transporting path 13.

When the selector plate 132 has been moved to the right cam position while the paper P stays in the paper transporting path 13, the selector plate 132 can be moved without a hitch with elongation of only the tensile coil spring 53 even when pivotal movement of the operation lever 52 is hindered. In this case, if the paper P is withdrawn from the paper transporting path 13, the tensile coil spring 53 causes the stationary arm 118*a* to remain in contact with the slope section 52*d* to pivot to the position of the stationary section 52*e*. The positioning stopper 118 and the operation lever 52 are returned to their predetermined initial positions.

As mentioned above, by the configuration in which the operation lever 52 is equipped with the cam section 52*b* for preventing pivotal movement of the positioning stopper 118, even when the paper P remains in the paper transporting path 13, the carriage 23 can be moved to the home position without loss of synchronism of the carriage motor 31 belonging to the step motor. Hence, there arises no quality deterioration, such as print displacement due to loss of synchronism. Even when a loss of synchronism has arisen, the number of initialization steps for ascertaining the position of the carriage 23 can be omitted.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

For example, the selector 32 may control movement of the carriage 23 by the number of steps of the carriage motor 31. Further, there may be provided a sensor for detecting movement of the selector 32.

Another method of preventing occurrence of meshing failures of the switching gear 39 is for supporting the pump drive gear 43 so as to be horizontally slidable and forcing the pump drive gear 43 rightward. According to this method, when the switching gear 39 does not mesh with the pump drive gear 43, the pump drive gear 43 escapes leftward, thereby permitting switching action of the switching gear 39. Subsequently, when the motor 42 is driven, the switching gear 39 is meshed with the pump drive gear 43, thereby preventing occurrence of meshing failures.

The embodiment has further described a case where the selector plate 32 takes three positions. However, for example, when the pair of second paper feed rollers are provided upstream of the MICR head 15, the selector plate 32 is arranged so as to be able to assume four positions, because the pair of paper feed rollers 16 disposed downstream of the MICR head 15 differ from the actuating mechanism of the pair of second paper feed rollers in terms of open and close states. The same advantage can be achieved, so long as three switching positions are provided for the carriage 23 in one of the two non-print areas and three restoration positions are provided in the remaining non-print areas.

The embodiment has described a case where the retainers 22 for pressing a check against the MICR head 15 are not rotated. However, the retainers 22 may be rollers.

Although the embodiment has employed the ink jet printer, the invention can also be applied to other applications, not the least of which include a serial impact-head printer and a serial thermal printer, exclusive of their pumps.

What is claimed is:

1. A printer, comprising:

a paper transporting path, which guides paper;

a print head, which performs printing on the paper placed in the paper transporting path;

a carriage, which carries the print head and reciprocates in a direction orthogonal to the paper transporting path;

a printing region provided within a reciprocating range of the carriage, in which the print head is allowed to perform printing;

a first non-printing region provided within the reciprocating range of the carriage, in which the print head is not allowed to perform printing, the first non-printing region provided adjacent to one side of the printing region;

a second non-printing region provided within the reciprocating range of the carriage, in which the print head is not allowed to perform printing, the second non-printing region provided adjacent to the other side of the printing region;

a plurality of switching mechanisms, each switching mechanism being movable between a first position and a second position; and a selector configured for operation by the carriage so as to move the selector to actuate at least one of the switching mechanisms to the second position when the carriage has moved to the first non-printing region, and to actuate the at least one of the switching mechanisms to the first position when the carriage has moved to the second non-printing region.

2. The printer as set forth in claim 1, wherein:

the selector is movable at least among a first selector position, a second selector position and a third selector position;

the first non-printing region includes at least a first switching position and a second switching position, and the second non-printing region includes at least a first restoration position and a second restoration position;

wherein the selector is placed at either one of the first, the second or the third selector positions to actuate the at least one switching mechanism to the second position when the carnage is placed at either one of the first switching position or the second switching position; and the selector is placed at either one of the first, the second or the third selector positions to actuate the at least one switching mechanism to the first position, when the carriage is placed at either one of the first restoration position or the second restoration position.

3. The printer as set forth in claim 2, further comprising a pair of paper feed rollers operable to transport the paper in the paper transporting path, and wherein the switching mechanisms include a paper feed roller actuating mechanism which opens or closes a space between the paper feed rollers.

4. The printer as set forth in claim 3, further comprising a positioning stopper against which a leading end of the paper in the paper transporting path is abutted, wherein the switching mechanisms include a positioning stopper actuating mechanism which actuates the positioning stopper so as to be projected into the paper transporting path or retracted therefrom.

5. The printer as set forth in claim 3, further comprising:

an MICR head which reads at least one magnetic character pre-printed on the paper; and a retainer, which retains the paper on the MICR head, wherein the switching mechanisms include an MICR actuating mechanism which opens or closes a space between the MICR head and the retainer.

6. The printer as set forth in claim 3, further comprising:

a pump which supplies ink to the print head; and a paper feed roller which transports the paper in the paper transporting path, wherein the switching mechanisms include a pump/roller switching mechanism which selectably transmits a driving force to either one of the pump or the paper feed roller.

7. The printer as set forth in claim 5, wherein:

the paper feed roller actuating mechanism is actuated at one of the first and the second switching positions, and at one of the first and the second restoration positions; and the MICR actuating mechanism is actuated at the other one of the first and the second switching positions, and at the other one of the first and the second restoration positions.

8. The printer as set forth in claim 7, wherein:

the paper feed roller actuating mechanism is actuated so as to close the space between the paper feed rollers at the first switching position, and so as to open the space at the second restoration position;

the MICR actuating mechanism is actuated so as to close the space between the MICR head and the retainer at the second switching position, and so as to open the space at the first restoration position;

the second switching position is placed outwardly from the first switching position in the first non-printing region; and the second restoration position is placed outwardly from the first retraction position in the second non-printing region.

9. The printer as set forth in claim 2, wherein the second non-printing region is provided as a home position of the carriage.

10. The printer as set forth in claim 1, wherein the switching mechanisms include:

at least one pair of stationary gears;

a switcher, moved by the selector; and a movable gear, moved by the switcher to mesh with one of the stationary gears while being rotated.

11. The printer as set forth in claim 3, wherein:

the paper feed roller includes a stationary feed roller and a movable feed roller which is retractably contacted with the stationary feed roller;

the paper feed roller actuating mechanism includes a switcher which changes a position of the movable feed roller with respect to the stationary feed roller; and the switcher is actuated when the switcher sits astride an operating section of the selector.

12. A printer, comprising:

a print head operable to print on a printable medium;

a carriage, which reciprocately carries the print head;

a printing region provided within a reciprocating range of the carriage, in which the print head is allowed to perform printing;

a first non-printing region provided within the reciprocating range of the carriage, in which the print head is not allowed to perform printing, the first non-printing region provided adjacent to one side of the printing region;

a second non-printing region provided within the reciprocating range of the carriage, in which the print head is not allowed to perform printing, the second non-printing region provided adjacent to the other side of the printing region;

a plurality of switching mechanisms, each switching mechanism being movable between a first position and a second position; and a selector associated with the carriage so as to move the selector to actuate at least one of the switching mechanisms to the second position when the carriage has moved to the first non-printing region, and to actuate the at least one of the switching mechanisms to the first position when the carriage has moved to the second non-printing region.

13. A method of controlling a printer, the printer including:

a paper transporting path, which guides paper, a print head, which performs printing on the paper placed in the paper transporting path, a carriage, which carries the print head and reciprocates in a direction orthogonal to the paper transporting path, a printing region provided within a reciprocating range of the carriage, in which the print head is allowed to perform printing, a first non-printing region provided within the reciprocating range of the carriage, in which the print head is not allowed to perform printing, the first non-printing region provided adjacent to one side of the printing region, a second non-printing region provided within the reciprocating range of the carriage, in which the print head is not allowed to perform printing, the second non-printing region provided adjacent to the other side of the printing region, a plurality of switching mechanisms, each switching mechanism being movable between a first position and a second position, and a selector configured for operation by the carriage so as to move the selector to actuate at least one of the switching mechanisms to the second position when the carriage has moved to the first non-printing region, and to actuate the at least one of the switching mechanisms to the first position when the carriage has moved to the second non-printing region, wherein:

the selector is movable at least among a first selector position, a second selector position and a third selector position, the first non-printing region includes at least a first switching position and a second switching position, and the second non-printing region includes at least a first restoration position and a second restoration position, the selector is placed at either one of the first, the second or the third selector positions to actuate the at least one switching mechanism to the second position when the carriage is placed at either one of the first switching position or the second switching position, and the selector is placed at either one of the first, the second or the third selector positions to actuate the at least one switching mechanism to the first position, when the carriage is placed at either one of the first restoration position or the second restoration position, the printer further comprising a pair of paper feed rollers operable to transport the paper in the paper transporting path, wherein the switching mechanisms include a paper feed roller actuating mechanism which opens or closes a space between the paper feed rollers, an MICR head which reads at least one magnetic character pre-printed on the paper, and a retainer, which retains the paper on the MICR head, wherein the switching mechanisms include an MICR actuating mechanism which opens or closes a space between the MICR head and the retainer, wherein:

the paper feed roller actuating mechanism is actuated at one of the first and the second switching positions, and at one of the first and the second restoration positions, the MICR actuating mechanism is actuated at the other one of the first and the second switching positions, and at the other one of the first and the second restoration positions, the paper feed roller actuating mechanism is actuated so as to close the space between the paper feed rollers at the first switching position, and so as to open the space at the second restoration position, the MICR actuating mechanism is actuated so as to close the space between the MICR head and the retainer at the second switching position, and so as to open the space at the first restoration position, the second switching position is placed outwardly from the first switching position in the first non-printing region, and the second restoration position is placed outwardly from the first retraction position in the second non-printing region, wherein the method comprises:

detecting an insertion of the paper into the paper transporting path;

moving the carriage to the second switching position via the first switching position;

reading the magnetic character on the paper by the MICR head while transporting the paper by the paper feed rollers;

moving the carriage to the first restoration position; and performing printing on the paper by the print head while transporting the paper by the paper feed roller.

* * * * *